US011126128B2

(12) United States Patent
Koizumi et al.

(10) Patent No.: US 11,126,128 B2
(45) Date of Patent: Sep. 21, 2021

(54) IMAGE FORMING APPARATUS

(71) Applicant: CANON KABUSHIKI KAISHA, Tokyo (JP)

(72) Inventors: Kazuhisa Koizumi, Chiba (JP); Toru Miyazawa, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/079,261

(22) Filed: Oct. 23, 2020

(65) Prior Publication Data

US 2021/0132536 A1 May 6, 2021

(30) Foreign Application Priority Data

Nov. 1, 2019 (JP) ..... JP2019-200314

(51) Int. Cl.
*G03G 15/00* (2006.01)
*G03G 15/01* (2006.01)

(52) U.S. Cl.
CPC ..... *G03G 15/6529* (2013.01); *G03G 15/0189* (2013.01); *G03G 15/5054* (2013.01); *G03G 15/6576* (2013.01)

(58) Field of Classification Search
CPC ..... G03G 15/6529
See application file for complete search history.

(56) References Cited

U.S. PATENT DOCUMENTS

2019/0146397 A1* 5/2019 Izumiya ..... G03G 15/2053 399/33
2019/0354046 A1* 11/2019 Onodera ..... G03G 15/2021
2020/0103811 A1* 4/2020 Sugiyama ..... B65H 3/0676
2020/0241442 A1* 7/2020 Onodera ..... G03G 15/326

FOREIGN PATENT DOCUMENTS

JP 2017151528 A 8/2017

* cited by examiner

*Primary Examiner* — Thomas S Giampaolo, II
(74) *Attorney, Agent, or Firm* — Canon U.S.A., Inc. I.P. Division

(57) ABSTRACT

An image forming apparatus includes a transfer unit, a fixing unit having a first rotating member and a second rotating member, and includes a first motor, a second motor, a drive transmission unit that operates in a first state and in a second state, and an adjustment member that adjusts a shaft-to-shaft distance and moves between a first position and a second position. In a state where a driving force of the second motor is not transmitted to the adjustment member located at the second position, the adjustment member maintains the shaft-to-shaft distance at a second distance that is shorter than a first distance. In a state where the drive transmission unit operates in the first state and the shaft-to-shaft distance is maintained at the second distance by the adjustment member located at the second position, the first rotating member is driven by both the first and second motors.

15 Claims, 19 Drawing Sheets

IMAGE FORMING APPARATUS

BACKGROUND

Field

The present disclosure relates to a technique for controlling a motor in an image forming apparatus.

Description of the Related Art

Conventionally, in an image forming apparatus, the pressure at a nip portion of a fixing roller in a fixing device is required to be made higher to form a higher quality image on a recording medium. To drive the fixing roller in a state where the pressure of the nip portion is higher than that in a conventional method, a motor having an output torque greater than the conventional method needs to be used. The greater the output torque of the motor is, the higher the cost is.

Japanese Patent Application Laid-Open No. 2017-151528 discusses a configuration in which two small motors are used as dedicated motors for driving a load. With such a configuration, it is possible to reduce cost as compared with a case where a load is driven using a single motor having a great output torque.

In the configuration of the publication of Japanese Patent Application Laid-Open No. 2017-151528, however, two dedicated motors are necessary to drive a load. Thus, a configuration is required in which a load can be driven with a less expensive configuration.

SUMMARY

The present disclosure is directed to driving a load with a less expensive configuration.

According to an aspect of the present disclosure, an image forming apparatus includes a transfer unit configured to transfer a toner image onto a recording medium, a fixing unit including a first rotating member and a second rotating member forming a nip portion with the first rotating member configured to nip the recording medium, wherein the fixing unit is configured to fix the toner image transferred onto the recording medium by the transfer unit to the recording medium at the nip portion, a first motor, a second motor, a drive transmission unit configured to transmit a driving force of the second motor, and an adjustment member having a position and configured to adjust a shaft-to-shaft distance between a first distance and a second distance that is shorter than the first distance, wherein the shaft-to-shaft distance is a distance between a first rotation shaft of the first rotating member and a second rotation shaft of the second rotating member, wherein the adjustment member is configured to move by the driving force of the second motor between a first position that is the position of the adjustment member in a state where the shaft-to-shaft distance is the first distance and a second position that is the position of the adjustment member in a state where the shaft-to-shaft distance is the second distance, and wherein the nip portion is formed by the first and second rotating members in the state where the shaft-to-shaft distance is the second distance, wherein the drive transmission unit operates in a first state where the driving force of the second motor is transmitted to the first rotating member and is not transmitted to the adjustment member, and in a second state where the driving force of the second motor is not transmitted to the first rotating member and is transmitted to the adjustment member, wherein, in a state where the driving force of the second motor is not transmitted to the adjustment member located at the second position, the adjustment member maintains the shaft-to-shaft distance at the second distance, and wherein, in a state where the drive transmission unit operates in the first state and the shaft-to-shaft distance is maintained at the second distance by the adjustment member located at the second position, the first rotating member is driven by both the first and second motors.

Further features of the present disclosure will become apparent from the following description of exemplary embodiments with reference to the attached drawings.

DESCRIPTION OF THE EMBODIMENTS

With reference to the drawings, exemplary embodiments of the present disclosure will be described below. However, the shapes and the relative arrangement of components described in these exemplary embodiments should be appropriately changed depending on the configuration of an apparatus to which the present disclosure is applied and various conditions, and the scope of the present disclosure is not limited to the following exemplary embodiments. In the following description, a case is described where a motor control device is provided in an image forming apparatus. However, the motor control device is not limited to be provided in an image forming apparatus. For example, the motor control device is also used in a sheet conveyance apparatus that conveys a sheet such as a recording medium or a document.

[Image Forming Apparatus]

Figure 1:
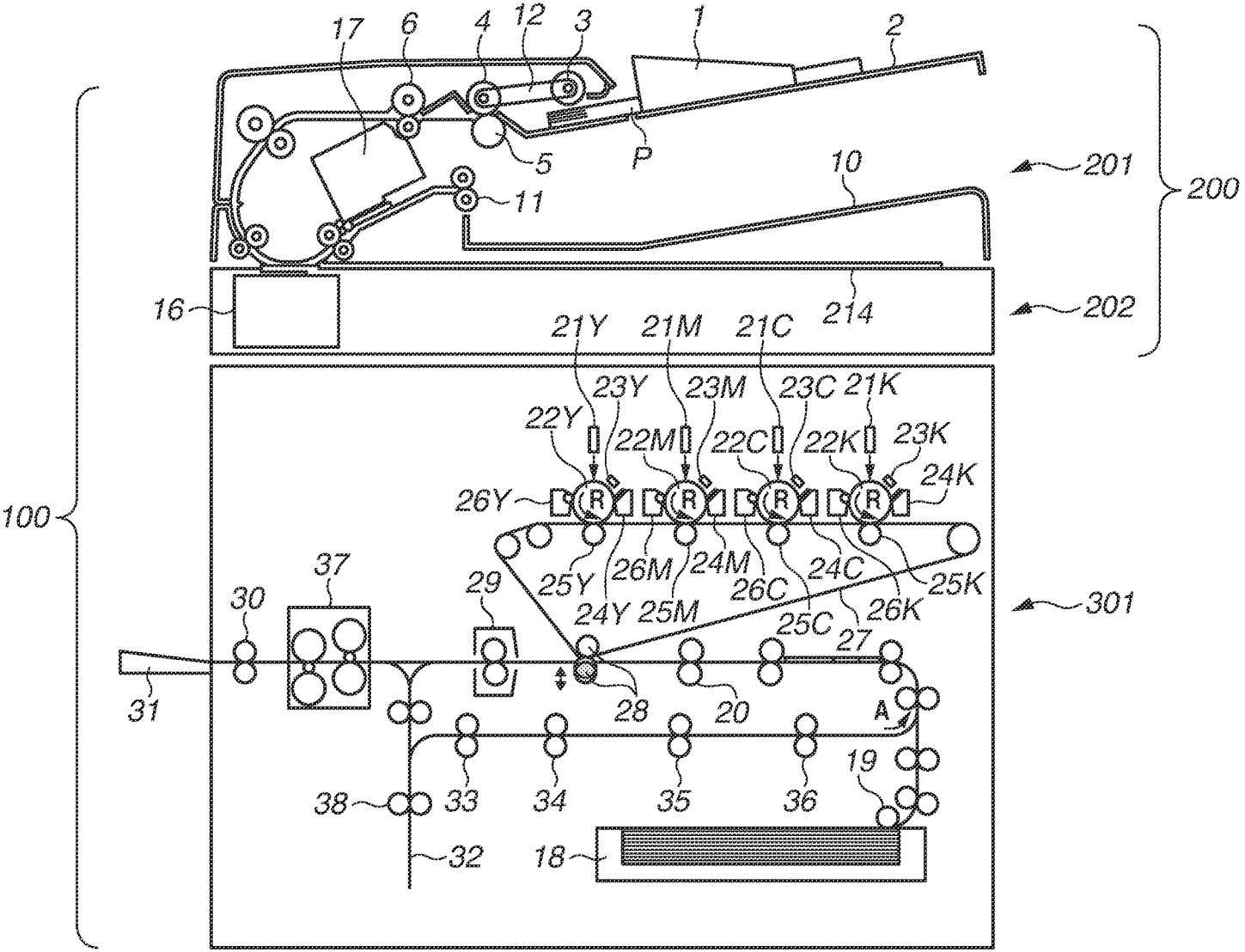
FIG. 1 is a cross-sectional diagram illustrating an image forming apparatus according to a first exemplary embodiment.

FIG. 1 is a cross-sectional diagram illustrating a configuration of a color electrophotographic copying machine (hereinafter referred to as "image forming apparatus") 100 used in a first exemplary embodiment. The image forming apparatus 100 is not limited to a copying machine, and may be, for example, a facsimile machine, a printing apparatus, or a printer. A recording method is not limited to an electrophotographic method, and may be, for example, an inkjet method. Further, the format of the image forming apparatus 100 may be either of monochrome and color formats.

With reference to FIG. 1, the configuration and the function of the image forming apparatus 100 are described. As illustrated in FIG. 1, the image forming apparatus 100 includes a document reading apparatus 200 including a document feeding apparatus 201 and a reading apparatus 202, and an image printing apparatus 301.

<Document Reading Apparatus>

Documents P stacked in a document stacking unit 2 of the document feeding apparatus 201 are fed one by one by a pickup roller 3. Then, each document P is further conveyed downstream by a feeding roller 4. At a position opposing the feeding roller 4, a separation roller 5 that is in pressure contact with the feeding roller 4 is provided. The separation roller 5 is configured to rotate if a load torque greater than or equal to a predetermined torque is applied to the separation roller 5. The separation roller 5 has a function of separating two documents fed in an overlapping state.

The pickup roller 3 and the feeding roller 4 are connected by a swinging arm 12. The swinging arm 12 is supported by a rotation shaft of the feeding roller 4 so that the swinging arm 12 can pivot about the rotation shaft of the feeding roller 4.

The document P is conveyed by the feeding roller 4 and discharged to a sheet discharge tray 10 by sheet discharge rollers 11.

In the reading apparatus 202, a document reading unit 16 for reading an image on a first surface of the conveyed document P is provided. Image information read by the document reading unit 16 is output to the image printing apparatus 301.

In the document feeding apparatus 201, a document reading unit 17 for reading an image on a second surface of the conveyed document P is provided. Image information read by the document reading unit 17 is output to the image printing apparatus 301 similarly to the method of the document reading unit 16 described above.

As described above, a document is read.

Document reading modes include a first reading mode and a second reading mode. The first reading mode is a mode for reading an image on a document conveyed by the above method. The second reading mode is a mode for reading an image on a document placed on document glass 214 of the reading apparatus 202 by the document reading unit 16 moving at a constant speed. Typically, an image on a sheet-like document is read in the first reading mode, and an image on a bound document such as a book or a booklet is read in the second reading mode.

<Image Printing Apparatus>

A sheet storage tray 18 for holding a recording medium is provided within the image printing apparatus 301. On the recording medium, an image is to be formed by the image forming apparatus 100. Examples of the recording medium include a paper sheet, a resin sheet, a cloth, an overhead projector (OHP) sheet, and a label.

The recording medium stored in the sheet storage tray 18 is sent out by a pickup roller 19 and conveyed to a registration roller 20 by conveyance rollers.

Color components of an image signal output from the document reading apparatus 200 are respectively input to optical scanning devices 21Y, 21M, 21C, and 21K, each including a semiconductor laser and a polygon mirror. More specifically, the image signal regarding yellow output from the document reading apparatus 200 is input to the optical scanning device 21Y. The image signal regarding magenta output from the document reading apparatus 200 is input to the optical scanning device 21M. The image signal regarding cyan output from the document reading apparatus 200 is input to the optical scanning device 21C. The image signal regarding black output from the document reading apparatus 200 is input to the optical scanning device 21K. Although the following description is given of a configuration in which a yellow image is formed, similar configurations are also provided for magenta, cyan, and black.

The outer peripheral surface of a photosensitive drum 22Y as a photosensitive member is charged by a charging device 23Y. After the outer peripheral surface of the photosensitive drum 22Y is charged, laser light corresponding to the image signal input from the document reading apparatus 200 to the optical scanning device 21Y is emitted from the optical scanning device 21Y to the outer peripheral surface of the photosensitive drum 22Y via an optical system such as a polygon mirror and mirrors. As a result, an electrostatic latent image is formed on the outer peripheral surface of the photosensitive drum 22Y.

Next, the electrostatic latent image is developed with toner in a developing device 24Y as a developing unit, thereby forming a toner image on the outer peripheral surface of the photosensitive drum 22Y. The toner image formed on the photosensitive drum 22Y is transferred onto a transfer belt 27 by a transfer roller 25Y provided at a position opposing the photosensitive drum 22Y. Toner remaining on the outer peripheral surface of the photosensitive drum 22Y after the toner image is transferred onto the transfer belt 27 is collected by a cleaning unit 26Y.

The yellow, magenta, cyan, and black toner images transferred onto the transfer belt 27 as a transfer unit are transferred onto the recording medium by a transfer roller pair 28. A high voltage is applied to the transfer roller pair 28, and the toner images are transferred onto the recording medium due to the high voltage. In synchronization with this transfer timing, the registration roller 20 sends the recording medium into the transfer roller pair 28.

The recording medium onto which the toner images have been transferred as described above is sent into a fixing device 29 as a fixing unit and is heated and pressed by the fixing device 29, thereby fixing the toner images to the recording medium. In this manner, an image is formed on the recording medium by the image forming apparatus 100.

In the recording medium to which the image is fixed by the fixing device 29, warp (curl) may occur due to the difference in the amount of moisture between the front and back sides of the recording medium. Thus, in the present exemplary embodiment, a curl correction mechanism 37 performs a process for reducing (removing) the curl on the recording medium to which the image is fixed by the fixing device 29. As a result, the curl having occurred in the recording medium is removed.

In a case where an image is formed in a one-sided printing mode, the recording medium having passed through the fixing device 29 passes through the curl correction mechanism 37 and is discharged to a sheet discharge tray 31 by a sheet discharge roller 30. In a case where an image is formed in a two-sided printing mode, a fixing process is performed on a first surface of the recording medium by the fixing device 29, and then, the recording medium is conveyed to a reverse path 32 by a reverse roller 38. The first surface and a second surface of the recording medium conveyed to the reverse path 32 are reversed by the reverse roller 38, and the recording medium is conveyed to a conveyance guide in which conveyance rollers 33, 34, 35, and 36 are provided. The recording medium is conveyed to the registration roller 20 again by the conveyance rollers 33, 34, 35, and 36, and an image is formed on the second surface of the recording medium by the above-described method. Then, the recording medium passes through the curl correction mechanism 37 as a curl correction unit and is discharged to the sheet discharge tray 31 by the sheet discharge roller 30.

This is the description of the configuration and the function of the image forming apparatus 100.

<Control Configuration of Image Forming Apparatus>

Figure 2:
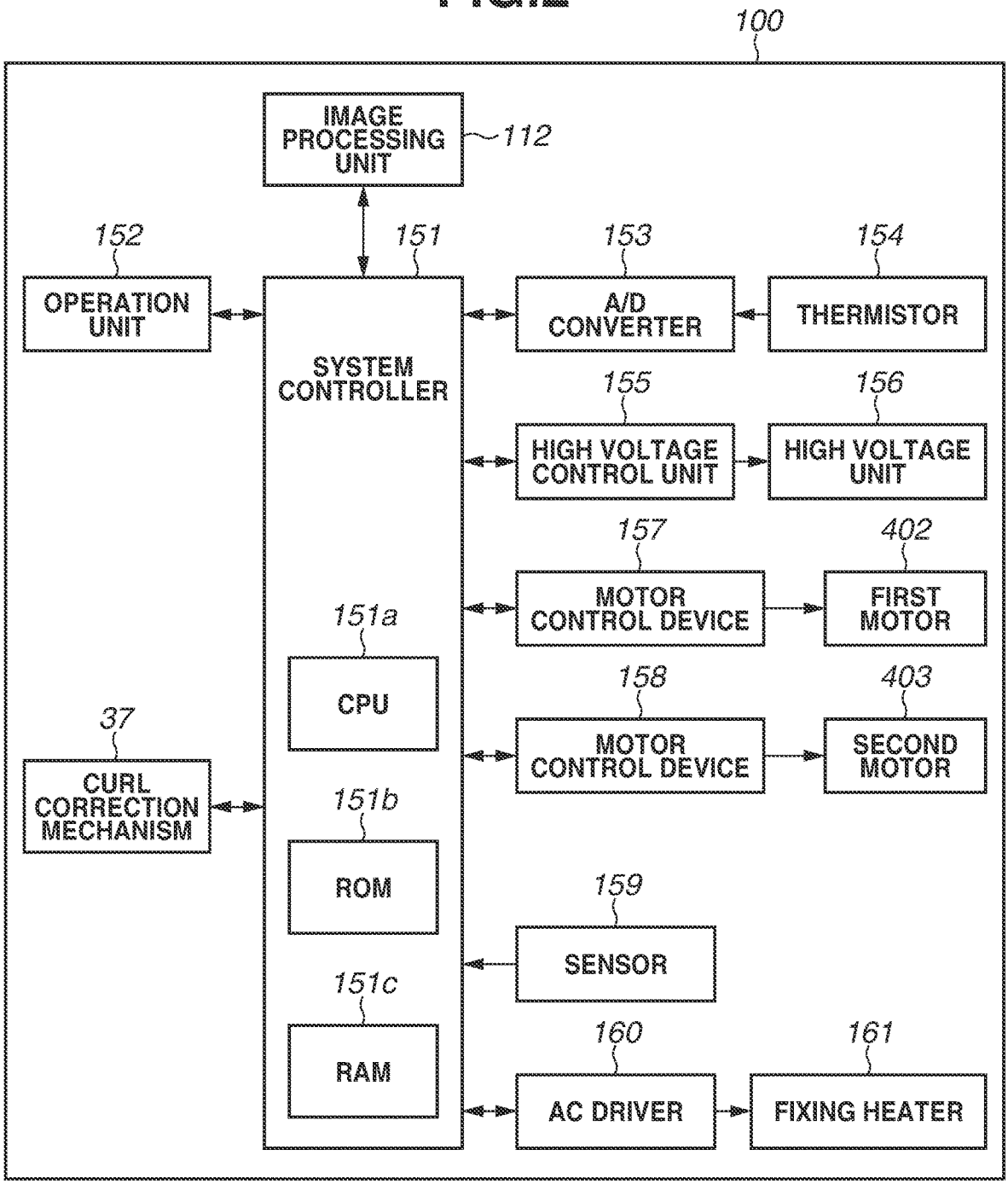
FIG. 2 is a block diagram illustrating a control configuration of the image forming apparatus.

FIG. 2 is a block diagram illustrating an example of a control configuration of the image forming apparatus 100. As illustrated in FIG. 2, a system controller 151 includes a central processing unit (CPU) 151*a*, a read-only memory (ROM) 151*b*, and a random-access memory (RAM) 151*c*. The system controller 151 is connected to the curl correction mechanism 37, an image processing unit 112, an operation unit 152, an analog-to-digital (A/D) converter 153, a high voltage control unit 155, motor control devices 157 and 158, a sensor 159, and an alternating current (AC) driver 160. The system controller 151 can transmit and receive data and a command to and from the units connected to the system controller 151.

The CPU 151*a* reads and executes various programs stored in the ROM 151*b*, thereby executing various sequences relating to an image forming sequence determined in advance.

The RAM 151*c* is a storage device. The RAM 151*c* stores various types of data such as a setting value for the high voltage control unit 155, an instruction value for the motor control devices 157 and 158, and information received from the operation unit 152.

The system controller 151 transmits setting value data, required for image processing by the image processing unit 112, of the various devices provided within the image forming apparatus 100 to the image processing unit 112. Further, the system controller 151 receives a signal from the sensor 159, and based on the received signal, sets a setting value of the high voltage control unit 155.

Corresponding to the setting value set by the system controller 151, the high voltage control unit 155 supplies a required voltage to a high voltage unit 156 (charging devices 23Y, 23M, 23C, and 23K, developing devices 24Y, 24M, 24C, and 24K, and transfer roller pair 28).

According to an instruction output from the CPU 151*a*, the motor control device 157 controls a first motor 402 that drives a load. According to an instruction output from the CPU 151*a*, the motor control device 158 controls a second motor 403 that drives a load. While only two motor control devices are illustrated in FIG. 2, actually, three or more motor control devices are provided in the image forming apparatus 100. Further, while only two motors are illustrated in FIG. 2, actually, three or more motors are provided in the image forming apparatus 100.

The A/D converter 153 receives a detected signal detected by a thermistor 154 that detects the temperature of a fixing heater 161. Then, the A/D converter 153 converts the detected signal from an analog signal to a digital signal and transmits the digital signal to the system controller 151. Based on the digital signal received from the A/D converter 153, the system controller 151 controls the AC driver 160. The AC driver 160 controls the fixing heater 161 so that the temperature of the fixing heater 161 becomes a temperature required to perform a fixing process. The fixing heater 161 is a heater used for the fixing process and is included in the fixing device 29.

The system controller 151 controls the operation unit 152 to display, on a display unit provided in the operation unit 152, an operation screen for a user to set the type of a recording medium to be used (hereinafter referred to as the "paper type"). The system controller 151 receives information set by the user from the operation unit 152, and controls the operation sequence of the image forming apparatus 100 based on the information set by the user. The system controller 151 transmits, to the operation unit 152, information indicating the state of the image forming apparatus 100. The information indicating the state of the image forming apparatus 100 is, for example, information regarding the number of images to be formed, the progress state of an image forming operation, and a jam or multi-feed of a sheet in the document reading apparatus 200 and the image printing apparatus 301. The operation unit 152 displays on the display unit the information received from the system controller 151.

As described above, the system controller 151 controls the operation sequence of the image forming apparatus 100.

[Fixing Device]

<Driving Configuration of Fixing Roller>

Figure 3:
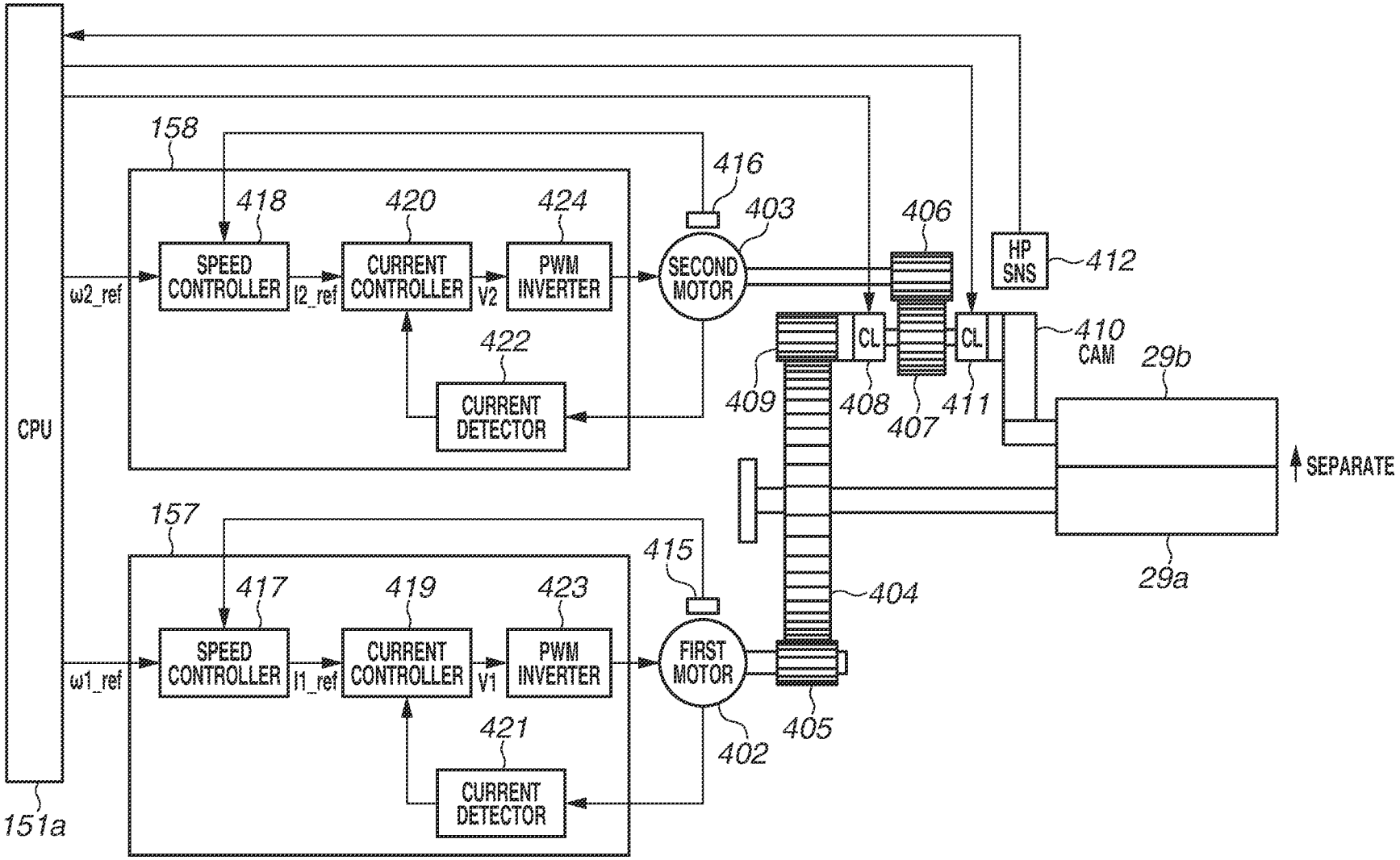
FIG. 3 is a block diagram illustrating a driving configuration of a fixing device according to the first exemplary embodiment.

FIG. 3 is a block diagram illustrating a driving configuration of the fixing device 29. The fixing device 29 includes a fixing roller 29*a* and a pressure roller 29*b*. A gear 404 is attached to the rotation shaft of the fixing roller 29*a*. When the gear 404 rotates, the fixing roller 29*a* also rotates. FIG. 3 illustrates a state where the pressure roller 29*b* is in contact (pressure contact) with the fixing roller 29*a*.

As illustrated in FIG. 3, a gear 405 provided on the rotation shaft of the first motor 402 is engaged with the gear 404. Thus, the driving force of the first motor 402 is transmitted to the fixing roller 29*a* via the gears 404 and 405.

As illustrated in FIG. 3, a gear 406 provided on the rotation shaft of the second motor 403 is engaged with a gear 407. The rotation shaft of the gear 407 is connected to the rotation shaft of a gear 409 through a clutch 408, and the gear 409 is engaged with the gear 404 at a position different from the position at which the gears 405 and 404 are engaged. Thus, in a state where the rotation shaft of the gear 407 is connected with the rotation shaft of the gear 409 through the clutch 408, the driving force of the second motor 403 is transmitted to the fixing roller 29*a* through the gears 404, 406, 407, and 409 and the clutch 408. On the other hand, in a state where the rotation shaft of the gear 407 is not connected with the rotation shaft of the gear 409, the driving force of the second motor 403 is not transmitted to the fixing roller 29*a*. The switching (state of clutch 408) between the state where the rotation shaft of the gear 407 is connected with the rotation shaft of the gear 409 through the clutch 408 and the state where the rotation shaft of the gear 407 is not connected with the rotation shaft of the gear 409 is controlled by the CPU 151*a*.

As described above, in the present exemplary embodiment, when the rotation shaft of the gear 407 is connected with the rotation shaft of the gear 409 by the clutch 408, the fixing roller 29*a* can be driven by both the first motor 402 and the second motor 403. In the present exemplary embodiment, when the rotation shaft of the gear 407 is not connected with the rotation shaft of the gear 409 by the clutch 408, this results in a state where the driving force of the second motor 403 is not transmitted to the fixing roller 29*a*, and the driving force of the first motor 402 is transmitted to the fixing roller 29*a*.

In the state where the pressure roller 29*b* is in contact with the fixing roller 29*a*, the pressure roller 29*b* rotates by being driven by the rotation of the fixing roller 29*a*.

The rotation shaft of a cam 410 is connected with the rotation shaft of the gear 407 through a clutch 411. Accordingly, in a state where the rotation shaft of the gear 407 is connected with the rotation shaft of the cam 410 through the clutch 411, the driving force of the second motor 403 is transmitted to the cam 410 through the gear 407 and the clutch 411. On the other hand, in a state where the rotation shaft of the gear 407 is not connected with the rotation shaft of the cam 410, the driving force of the second motor 403 is not transmitted to the cam 410. The switching (state of clutch 411) between the state where the rotation shaft of the gear 407 is connected with the rotation shaft of the cam 410 through the clutch 411 and the state where the rotation shaft of the gear 407 is not connected with the rotation shaft of the cam 410 is controlled by the CPU 151*a*. In other words, the CPU 151*a* functions as a transmission control unit.

Figure 4:
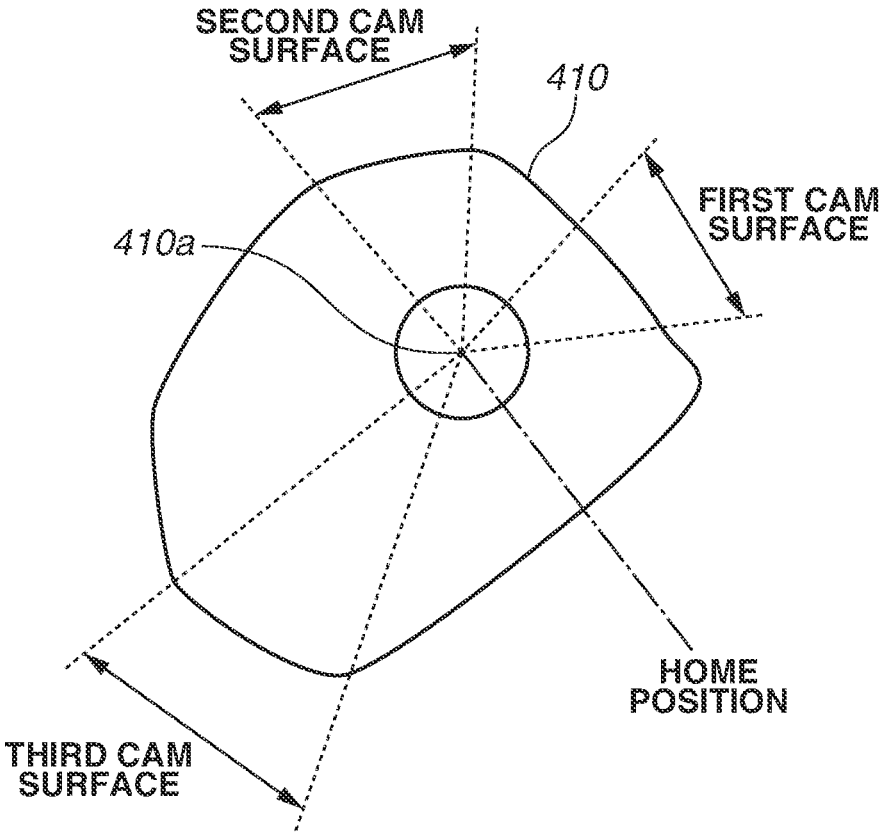
FIG. 4 is a diagram illustrating a shape of a cam.

FIG. 4 is a diagram illustrating a shape of the cam 410. As illustrated in FIG. 4, the cam 410 includes a first cam surface that is away from a rotation center 410*a* of the cam 410 by a first distance, a second cam surface that is away from the rotation center 410*a* of the cam 410 by a second distance that is longer than the first distance, and a third cam surface that is away from the rotation center 410*a* of the cam 410 by a third distance that is longer than the second distance.

When the cam 410 rotates, the outer peripheral surface of the cam 410 comes into contact with, for example, the rotation shaft of the pressure roller 29*b*, and the rotation shaft of the pressure roller 29*b* is displaced. As a result, the distance (shaft-to-shaft distance) between the rotation shaft of the pressure roller 29*b* and the rotation shaft of the fixing roller 29*a* changes. The distance between the rotation shaft of the pressure roller 29*b* and the rotation shaft of the fixing roller 29*a* in the state where the first cam surface is in contact with the rotation shaft of the pressure roller 29*b* (first state) is greater than a second distance that is a distance between the rotation shaft of the pressure roller 29*b* and the rotation shaft of the fixing roller 29*a* in a state where the second cam surface is in contact with the rotation shaft of the pressure roller 29*b* (second state). The distance between the rotation shaft of the pressure roller 29*b* and the rotation shaft of the fixing roller 29*a* in the second state is greater than the distance between the rotation shaft of the pressure roller 29*b* and the rotation shaft of the fixing roller 29*a* in a state where the third cam surface is in contact with the rotation shaft of the pressure roller 29*b* (third state). More specifically, the pressure at a nip portion formed by the pressure roller 29*b* and the fixing roller 29*a* in the first state is smaller than the pressure of the nip portion formed by the pressure roller 29*b* and the fixing roller 29*a* in the second state. The pressure of the nip portion formed by the pressure roller 29*b* and the fixing roller 29*a* in the second state is smaller than the pressure of the nip portion formed by the pressure roller 29*b* and the fixing roller 29*a* in the third state.

In the fixing device 29, a home position sensor 412 that detects the rotational phase of the cam 410 being a predetermined phase (i.e., the cam 410 is located at a home position) is provided.

In the present exemplary embodiment, in a state where the cam 410 is located at the home position, the pressure roller 29*b* is separate from the fixing roller 29*a*. However, it is not limited thereto. For example, in the state where the cam 410 is located at the home position, the pressure roller 29*b* may be in contact with the fixing roller 29*a*. In this case, the cam 410 is rotated by a predetermined amount from the state where the cam 410 is located at the home position, whereby the pressure roller 29*b* can be separated from the fixing roller 29*a*. By using a configuration in which the pressure roller 29*b* separates from the fixing roller 29*a*, it is possible to easily remove jammed paper in the fixing device 29. It is also possible to prevent the fixing roller 29*a* and the pressure roller 29*b* from deforming due to the continuation of the state where the pressure roller 29*b* is in contact with the fixing roller 29*a*.

When the rotation of the cam 410 is started from the state where the cam 410 is located at the home position, the rotation shaft of the pressure roller 29*b* comes into contact with the first, second, and third cam surfaces in this order. The first, second, and third cam surfaces are approximately flat surfaces. In the states where the first, second, and third cam surfaces are in contact with the rotation shaft of the pressure roller 29*b*, even if the excitation of the second motor 403 is stopped, the cam 410 does not rotate. More specifically, in the states where the first, second, and third cam surfaces are in contact with the rotation shaft of the pressure roller 29*b*, even if the excitation of the second motor 403 is stopped, the rotational phase of the cam 410 is maintained, and the rotation shaft of the pressure roller 29*b* is not displaced. As a result, even if the excitation of the second motor 403 is stopped, the distance between the rotation shaft of the pressure roller 29*b* and the rotation shaft of the fixing roller 29*a* can be maintained.

<Motor Control Devices>

Next, the motor control devices 157 and 158 are described. Although the motor control device 157 is described below, the motor control device 158 also has a similar configuration.

The motor control device 157 includes at least one application-specific integrated circuit (ASIC) or executes functions described below.

The CPU 151*a* outputs an instruction speed ω1_ref representing a target speed of a rotor of the first motor 402 to the motor control device 157.

A rotary encoder 415 detects the rotational speed of the rotor of the first motor 402 and outputs the detection result to a speed controller 417. The rotary encoder 415 includes a light-emitting portion that emits light, a light-receiving portion that receives the light emitted from the light-emitting portion, and a disk in which a slit that allows the passage of the light emitted from the light-emitting portion are provided at each predetermined angle. Each or every time the light-receiving portion receives light, the rotary encoder 415 outputs a pulse signal as the detection result.

The speed controller 417 acquires a deviation between the rotational speed indicated by the detection result output from the rotary encoder 415 and the instruction speed ω1_ref output from the CPU 151*a* at a period T (e.g., 200 μs). Based on proportional control (P), integral control (I), and derivative control (D), the speed controller 417 generates an instruction value I1_ref of the amplitude of a current to be supplied to a coil of the first motor 402 so that the deviation to be acquired becomes small. Then, the speed controller 417 outputs the instruction value I1_ref. More specifically, based on the P-control, the I-control, and the D-control, the speed controller 417 generates the instruction value I1_ref so that the deviation to be acquired becomes 0. Then, the speed controller 417 outputs the instruction value I1_ref. The P-control is a control method for controlling the value of a target to be controlled, based on a value proportional to the deviation between an instruction value and an estimated value. The I-control is a control method for controlling the value of the target to be controlled, based on a value proportional to the time integral of the deviation between the instruction value and the estimated value. The D-control is a control method for controlling the value of the target to be controlled, based on a value proportional to a change over time in the deviation between the instruction value and the estimated value. The speed controller 417 according to the present exemplary embodiment generates the instruction value I1_ref based on the proportional-integral-derivative (PID) control. However, it is not limited thereto. For example, the speed controller 417 may generate the instruction value I1_ref based on proportional-integral (PI) control.

The instruction value I1_ref output from the speed controller 417 is output to a current controller 419.

A driving current flowing through the coil of the first motor 402 is detected by a current detector 421 and converted from an analog value to a digital value. The current value output from the current detector 421 is input to the current controller 419.

Based on the PID control, the current controller 419 generates a driving voltage V1 so that the deviation between the instruction value I1_ref and the current value output from the current detector 421 becomes small. More specifically, the current controller 419 generates the driving voltage V1 so that the deviation between the instruction value I1_ref and the current value output from the current detector 421 becomes 0. The current controller 419 according to the present exemplary embodiment generates the driving voltage V1 based on the PID control. However, it is not limited thereto. For example, the current controller 419 may generate the driving voltage V1 based on the PI control.

A pulse-width modulation (PWM) inverter 423 includes a full-bridge circuit. The full-bridge circuit is driven by a PWM signal based on the driving voltage V1. As a result, the PWM inverter 423 generates a driving current I1 corresponding to the driving voltage V1 and supplies the driving current I1 to the coil of the first motor 402, thereby driving the first motor 402. In the present exemplary embodiment, the PWM inverter 423 includes a full-bridge circuit. Alternatively, the PWM inverter 423 may include a half-bridge circuit.

<Method for Driving Fixing Roller>

Next, a method for driving the fixing roller 29*a* is described. In the present exemplary embodiment, the following configuration is applied, thereby driving the fixing roller 29*a* as a load with a less expensive configuration.

Figure 5:
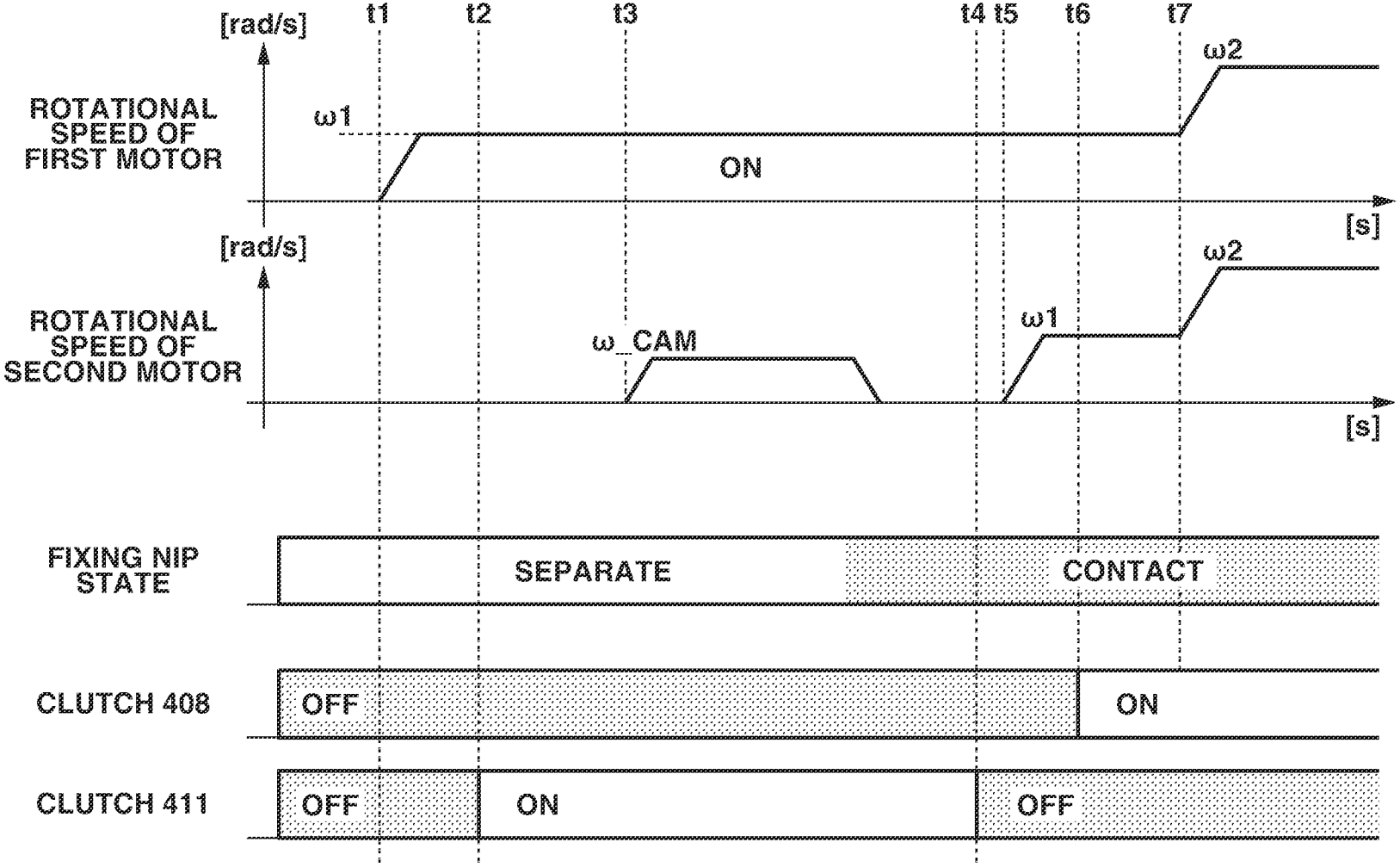
FIG. 5 is a timing chart illustrating a method for driving a first roller according to the first exemplary embodiment.

FIG. 5 is a timing chart illustrating a method for driving the fixing roller 29*a*. FIG. 5 illustrates the rotational speed of the rotor of the first motor 402, the rotational speed of a rotor of the second motor 403, the nip state of the fixing roller 29*a* and the pressure roller 29*b*, and the states of the clutches 408 and 411. The off states of the clutches 408 and 411 correspond to the states where the driving forces from the motors are cut off. The on states of the clutches 408 and 411 correspond to the states where the driving forces from the motors are transmitted.

First, in a state where the pressure roller 29*b* is separate from the fixing roller 29*a*, and the clutches 408 and 411 are off, the CPU 151*a* outputs a first velocity ω1 as an instruction speed ω1_ref to the motor control device 157 so that the rotor of the first motor 402 rotates at the first speed ω1 (time t1). As a result, the fixing roller 29*a* rotates at an angular speed corresponding to the first speed ω1. The first speed ω1 is set to a speed lower than a second speed ω2 that is the rotational speed of the rotor of the first motor 402 when an image is fixed to a recording medium. The first speed w 1 is also set to such a speed that a load torque applied to the rotor of the first motor 402 rotating at the first speed ω1 does not exceed a torque that can be output from the first motor 402. Further, the first speed ω1 is set to such a speed that a load torque applied to the rotor of the first motor 402 rotating at the first speed ω1 in the state where the pressure roller 29*b* is in contact with the fixing roller 29*a* does not exceed the torque that can be output from the first motor 402.

When the rotational speed of the rotor of the first motor 402 reaches the first speed ω1, the CPU 151*a* brings the clutch 411 into the on state. More specifically, the CPU 151*a* changes the state of the clutch 411 to the state where the driving force of the second motor 403 is transmitted to the cam 410 (time t2).

Then, the CPU 151*a* outputs a predetermined speed ω_CAM as an instruction speed ω2_ref to the motor control device 158 so that the pressure at the nip portion formed by the pressure roller 29*b* and the fixing roller 29*a* becomes a predetermined pressure. Then, the CPU 151*a* drives the second motor 403 at the predetermined speed ω_CAM for a predetermined time (time t3). The predetermined pressure is a pressure required to fix toner images to the recording medium, and for example, is set based on the paper type. The predetermined time is set to the rotation time of the second motor 403 required for the pressure of the nip portion formed by the pressure roller 29*b* and the fixing roller 29*a* to become the predetermined pressure. Examples of the method for rotating the second motor 403 by a predetermined amount include the following method. Specifically, in a case where the second motor 403 is a stepping motor, the second motor 403 is rotated as many steps as the number of pulses corresponding to the predetermined amount. As the first motor 402, a stepping motor may be used, or a brushless direct current (DC) motor or a brush motor may be used. As the second motor 403, a stepping motor may be used, or a brushless DC motor or a brush motor may be used.

Next, the CPU 151*a* brings the clutch 411 into the off state. More specifically, the CPU 151*a* changes the state of the clutch 411 to the state where the driving force of the second motor 403 is not transmitted to the cam 410 (time t4).

Then, the CPU 151*a* outputs the first speed ω1 as the instruction speed ω2_ref to the motor control device 158 so that the second motor 403 is driven at the first speed col (time t5).

If the rotational speed of the rotor of the second motor 403 reaches the first speed ω1, the CPU 151*a* brings the clutch 408 into the on state. In other words, the CPU 151*a* changes the state of the clutch 408 to the state where the driving force of the second motor 403 is transmitted to the gear 409 (time t6). As a result, the fixing roller 29*a* is driven at the angular speed corresponding to the first speed ω1 by both the first motor 402 and the second motor 403.

Then, the CPU 151*a* outputs the second speed ω2 as the instruction speed col ref to the motor control device 157 and outputs the second speed ω2 as the instruction speed ω2_ref to the motor control device 158 so that the first motor 402 and the second motor 403 are driven at the second speed ω2 (time t7). As a result, the fixing roller 29*a* and the pressure roller 29*b* rotate at an angular speed when toner images are fixed to the recording medium.

When an image forming job ends, the CPU 151*a* brings the clutch 408 into the off state and brings the clutch 411 into the on state. Then, the CPU 151*a* rotates the second motor 403 until the home position sensor 412 detects that the cam 410 is located at the home position.

Figure 6:
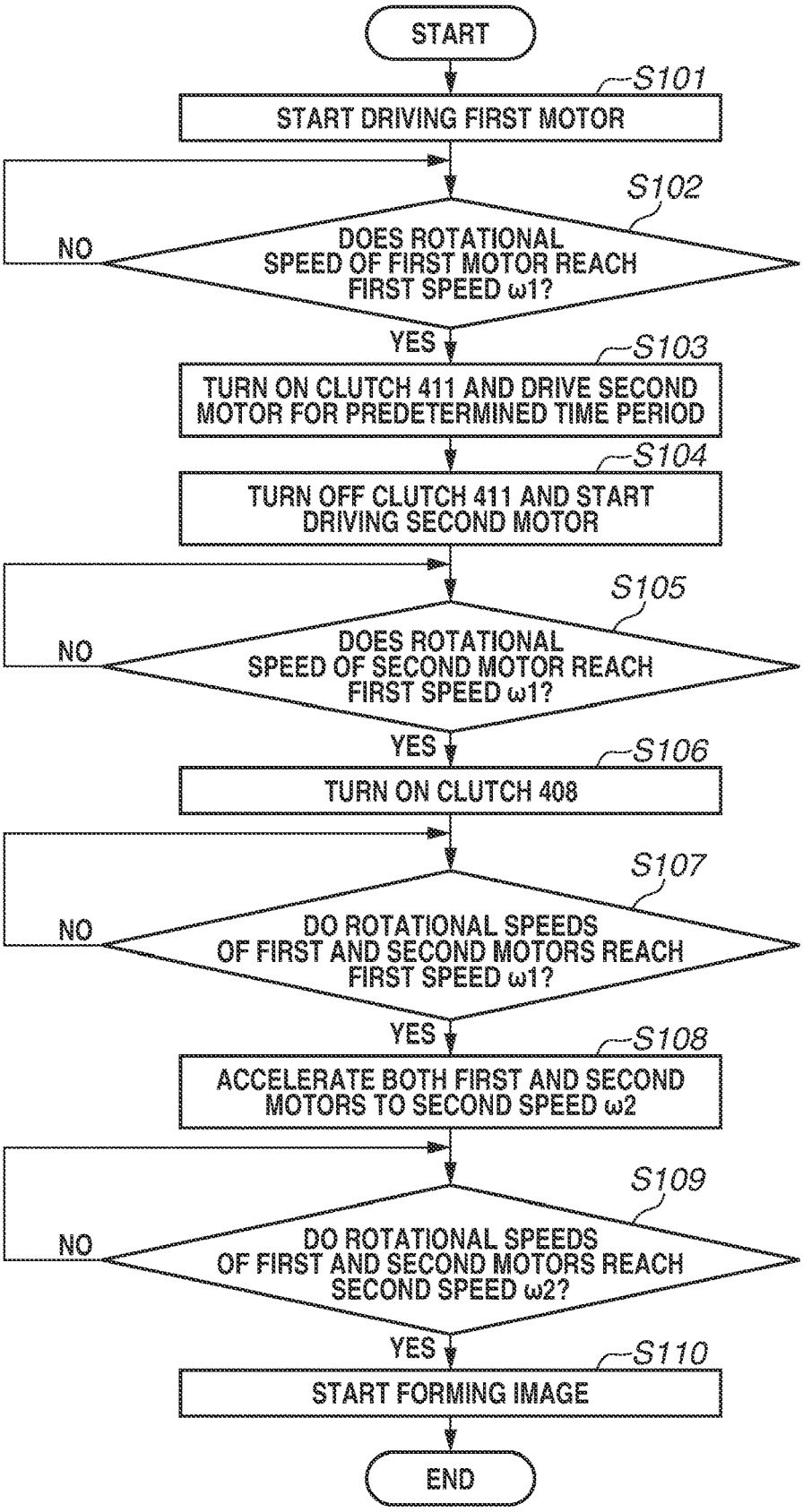
FIG. 6 is a flowchart illustrating the method for driving the first roller according to the first exemplary embodiment.

FIG. 6 is a flowchart illustrating a method for driving the fixing roller 29*a*. With reference to FIG. 6, the method for driving the fixing roller 29*a* is described. The processing of this flowchart is executed by the CPU 151*a*. The processing of this flowchart is executed when a job for forming an image is started. Before the processing of this flowchart is started, the pressure roller 29*b* is separate from the fixing roller 29*a*, and the clutches 408 and 411 are in the off states.

When the job for forming an image is started, then in step S101, the CPU 151*a* controls the motor control device 157 so that the first motor 402 rotates at the first speed col (time t1). As a result, the motor control device 157 starts driving the first motor 402, and the fixing roller 29*a* rotates. When the driving of the first motor 402 is started, the CPU 151*a* starts controlling the temperature of the fixing heater 161 provided in the fixing roller 29*a*. When the driving of the first motor 402 is started, the control of the temperature of the fixing heater 161 is started, whereby it is possible to prevent the uneven distribution of places on the fixing roller 29*a* to be heated.

Next, in step S102, when the rotational speed of the rotor of the first motor 402 reaches the first speed ω1 (YES in step S102), then in step S103, the CPU 151*a* brings the clutch 411 into the on state (time t2). The CPU 151*a* also controls the motor control device 158 so that the second motor 403 rotates at the predetermined speed ω_CAM for the predetermined time (time t3). As a result, the pressure at the nip portion formed by the pressure roller 29*b* and the fixing roller 29*a* becomes the predetermined pressure.

Next, in step S104, the CPU 151*a* brings the clutch 411 into the off state (time t4). The CPU 151*a* also controls the motor control device 158 so that the second motor 403 rotates at the first speed col (time t5). As a result, the motor control device 158 starts driving the second motor 403.

In step S105, if the rotational speed of the rotor of the second motor 403 reaches the first speed ω1 (YES in step S105), then in step S106, the CPU 151*a* brings the clutch 408 into the on state (time t6).

In step S107, when the rotational speed of the rotor of the first motor 402 and the rotational speed of the rotor of the second motor 403 reach the first speed ω1 (YES in step S107), then in step S108, the CPU 151*a* controls the motor control devices 157 and 158 so that the first motor 402 and the second motor 403 rotate at the second speed ω2 (time t7).

Next, in step S109, when the rotational speed of the rotor of the first motor 402 and the rotational speed of the rotor of the second motor 403 reach the second speed ω2 (YES in step S109), then in step S110, the CPU 151*a* starts forming an image on a recording medium by the image printing apparatus 301.

As described above, in the present exemplary embodiment, when a toner image is fixed to a recording medium, the fixing roller 29*a* is driven using the first motor 402 for driving the fixing roller 29*a*, and the second motor 403 for adjusting the distance between the rotation shaft of the pressure roller 29*b* and the rotation shaft of the fixing roller 29*a*. More specifically, in the present exemplary embodiment, the second motor 403 that is the motor for adjusting the distance between the rotation shaft of the pressure roller 29*b* and the rotation shaft of the fixing roller 29*a* is used also as a motor for driving the fixing roller 29*a*. As a result, it is possible to reduce cost compared with a case where two dedicated motors for driving the fixing roller 29*a* are used. In this way, it is possible to drive a load with a less expensive configuration.

In the present exemplary embodiment, the rotational speeds of the rotors of the first motor 402 and the second motor 403 are detected by sensors such as rotary encoders. However, it is not limited thereto. For example, the rotational speeds of the rotors of the first motor 402 and the second motor 403 may be determined based on inductive voltages generated across the coils of the motors, or may be determined based on driving currents flowing through the coils.

In the present exemplary embodiment, the on and off states of the clutches 408 and 411 are controlled, thereby controlling the transmission of the driving force of the second motor 403. However, it is not limited thereto. For example, a one-way clutch 408' may be used instead of the clutch 408, and a one-way clutch 411' may be used instead of the clutch 411. In this case, the one-way clutch 408' is provided so that, when the second motor 403 rotates in a first rotational direction for rotating the fixing roller 29*a*, the driving force of the second motor 403 is transmitted to the gear 409. The one-way clutch 411' is provided so that, when the second motor 403 rotates in a direction opposite to the first rotational direction, the driving force of the second motor 403 is transmitted to the cam 410.

Figure 7:
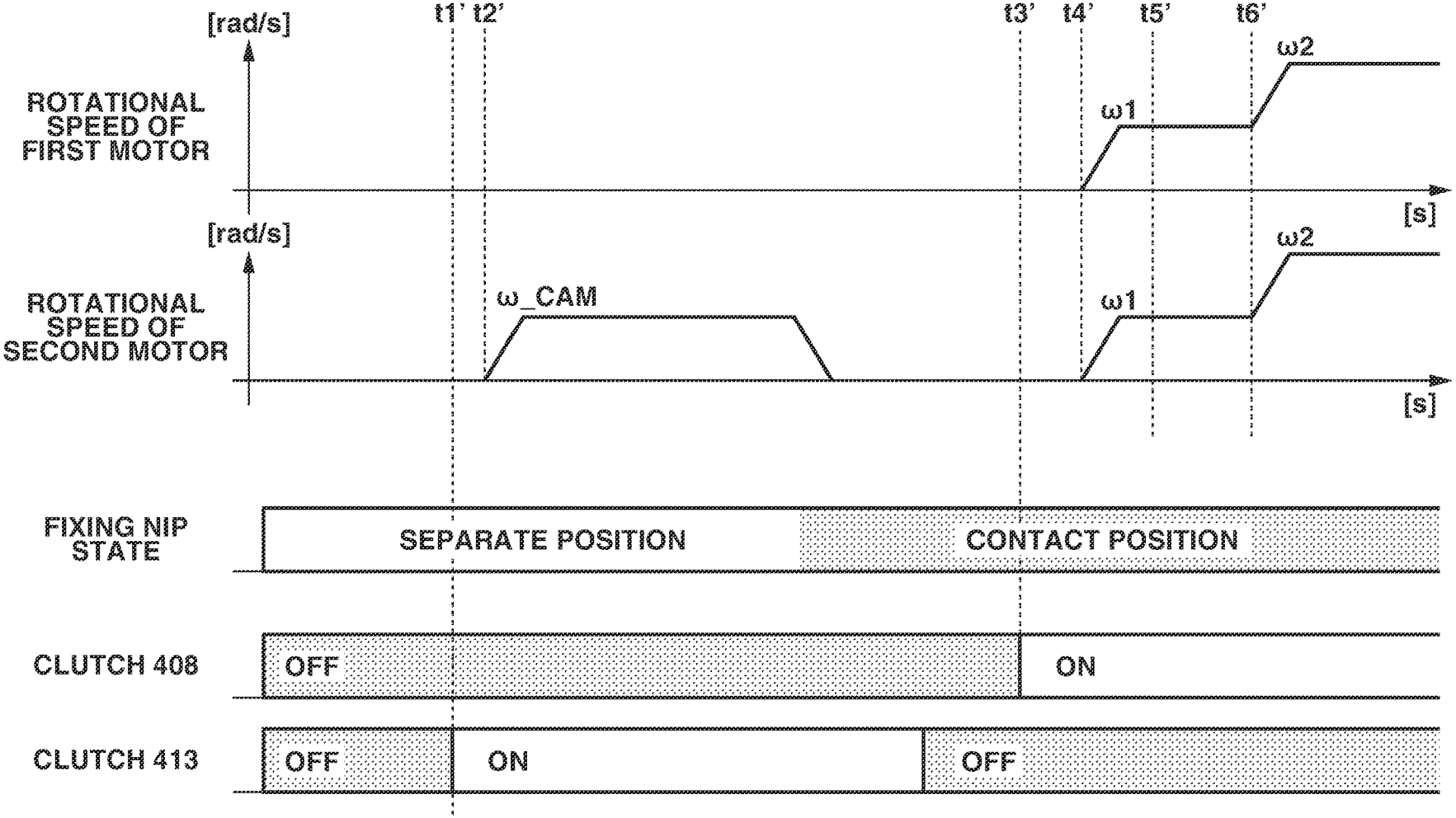
FIG. 7 is a timing chart illustrating another method for driving the first roller according to the first exemplary embodiment.

In the present exemplary embodiment, as illustrated in FIG. 5, in the state where the pressure roller 29*b* is separate from the fixing roller 29*a*, and the clutches 408 and 411 are in the off state, the CPU 151*a* drives the first motor 402 at the first speed ω1. However, it is not limited thereto. For example, as illustrated in FIG. 7, the second motor 403 may be rotated for a predetermined time period, and in the state where the clutch 408 is on, and a clutch 413 is off, the driving of both the first motor 402 and the second motor 403 may be started (time t4'). In other words, the driving of the fixing roller 29*a* may be started using both the first motor 402 and the second motor 403.

In the present exemplary embodiment, at the time t3, the CPU 151*a* outputs the predetermined speed ω_CAM as the instruction speed ω2_ref and drives the second motor 403 for the predetermined time period. Then, the CPU 151*a* stops the second motor 403 and brings the clutch 411 into the off state. Then, at the time t5, the CPU 151*a* outputs the first speed ω1 as the instruction speed ω2_ref. When the rotational speed of the rotor of the second motor 403 reaches the first speed ω1, the CPU 151*a* brings the clutch 408 into the on state. However, it is not limited thereto. For example, at the time t3, the CPU 151*a* may output the first speed ω1 as the instruction speed ω2_ref and drive the second motor 403 for the predetermined time period. Then, the CPU 151*a* may bring the clutch 411 into the off state and bring the clutch 408 into the on state without stopping the second motor 403. More specifically, in the period from when the driving of the cam 410 is started to when the clutch 408 enters the on state, the state where the second motor 403 is driven at the first speed ω1 may be maintained. Alternatively, for example, at the time t3, the CPU 151*a* may output a speed different from the first speed ω1 as the instruction speed ω2_ref, and when the clutch 408 enters the on state, the CPU 151*a* may output the first speed ω1 as the instruction speed ω2_ref.

Figure 8:
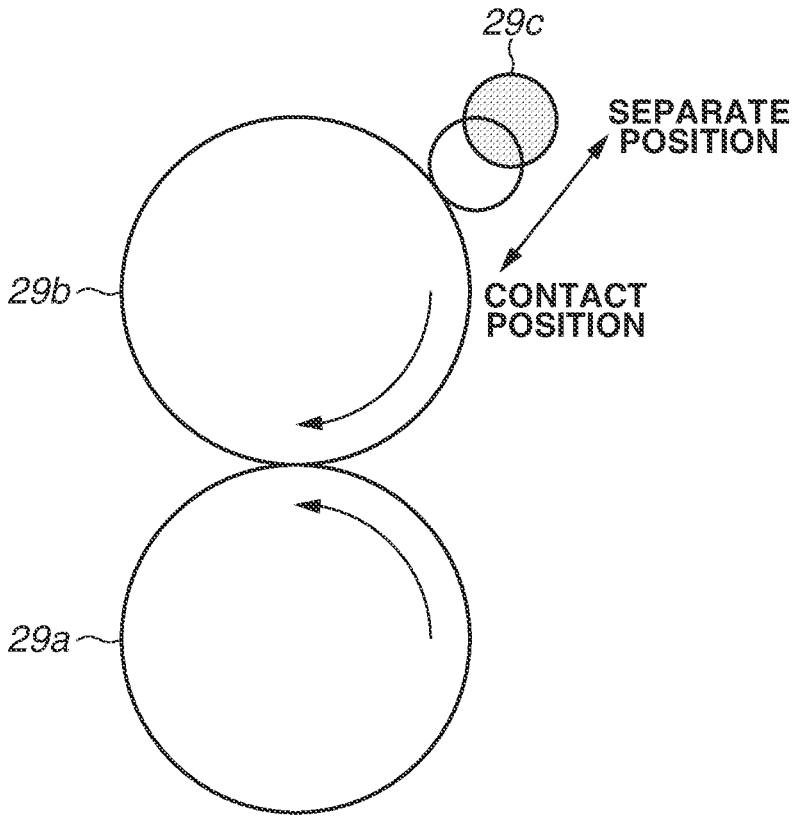
FIG. 8 is a diagram illustrating a cleaning member that cleans an outer peripheral surface of a roller.

In the present exemplary embodiment, the second motor 403 for adjusting the distance between the rotation shaft of the pressure roller 29*b* and the rotation shaft of the fixing roller 29*a* is used also to drive the fixing roller 29*a*. However, it is not limited thereto. For example, as illustrated in FIG. 8, a motor for bringing a cleaning member 29*c* that cleans the outer peripheral surface of a roller into contact with the roller and for separating the cleaning member 29*c* from the roller may also be used to drive the fixing roller 29*a*. As a result, it is possible to drive a load with a less expensive configuration.

In the present exemplary embodiment, the fixing device 29 fixes toner image to a recording medium using the pressure roller 29*b* and the fixing roller 29*a*. However, it is not limited thereto. For example, the fixing device 29 may fix a toner image to a recording medium using a roller and a film, or may fix a toner image to a recording medium using a roller and a belt. In this case, a motor used to bring the roller into contact with the film or the belt and separate the roller from the film or the belt is used also to drive the roller. As a result, it is possible to drive a load with a less expensive configuration.

Next, a second exemplary embodiment is described. Components of an image forming apparatus 100 according to the second exemplary embodiment that are similar to those of the image forming apparatus 100 according to the first exemplary embodiment are not described.

When a recording medium is conveyed from the reverse path 32 to the registration roller 20, the recording medium passes through a conveyance path indicated by an arrow A illustrated in FIG. 1. The conveyance path indicated by the arrow A is curved. A load torque applied to the conveyance roller 36 that conveys the recording medium to the curved conveyance path is greater than a load torque applied to conveyance roller (e.g., the conveyance roller 34) that conveys the recording medium to a horizontal conveyance path. Particularly, in a case where a recording medium having relatively large stiffness or grammage (e.g., thick paper) is conveyed, a load torque applied to the conveyance roller 36 is greater than a load torque applied to the conveyance roller 34. This is because, when a recording medium having relatively large stiffness or grammage is conveyed to a curved conveyance path, the firmness of the recording medium results in applying a force in a direction opposite to the conveying direction to conveyance rollers that convey the recording medium to the curved conveyance path. Thus, to drive the conveyance rollers that convey the recording medium to the curved conveyance path, a high-output motor is required. The higher the output of the motor is, the higher the cost is. With this reason, in the present exemplary embodiment, the following configuration is applied, thereby driving the conveyance rollers as a load with a less expensive configuration.

<Driving Configuration of Conveyance Rollers>

Figure 9:
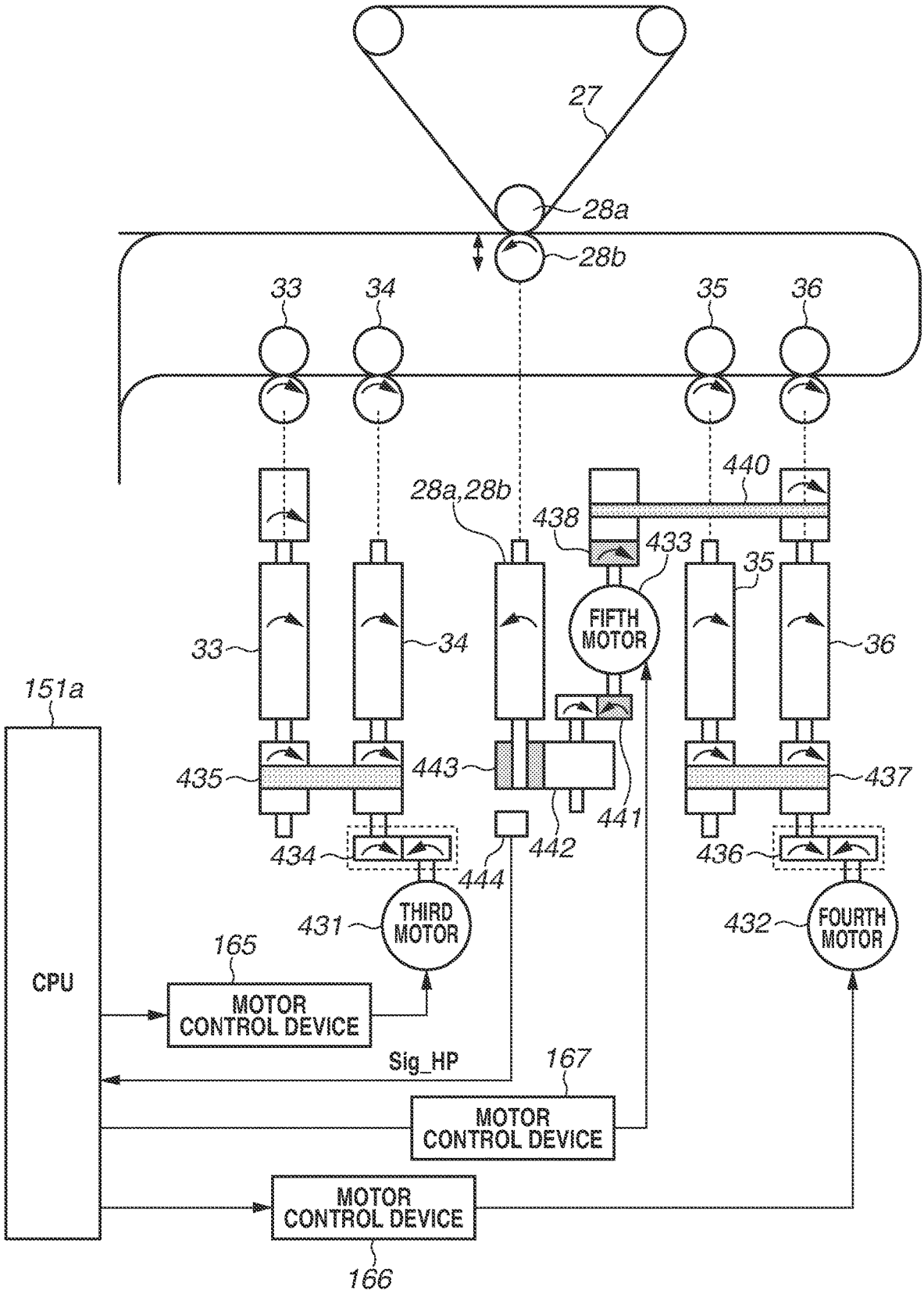
FIG. 9 is a diagram illustrating a driving configuration of conveyance rollers according to a second exemplary embodiment.

FIG. 9 is a diagram illustrating a driving configuration of the conveyance rollers. Arrows illustrated in FIG. 9 indicate the rotational directions of rotating members. The configurations of motor control devices 165, 166, and 167 are similar to the configuration of the motor control device 157 according to the first exemplary embodiment, and therefore are not described.

The driving force of a third motor 431 is transmitted to the conveyance roller 34 by a gear 434. The rotation shaft of the conveyance roller 34 is connected with the rotation shaft of the conveyance roller 33 by a belt 435. In this way, the driving force of the third motor 431 is transmitted also to the conveyance roller 33 by the belt 435.

The driving force of a fourth motor 432 is transmitted to the conveyance roller 36 by a gear 436. The rotation shaft of the conveyance roller 36 is connected with the rotation shaft of the conveyance roller 35 by a belt 437. In this way, the driving force of the fourth motor 432 is transmitted also to the conveyance rollers 35 by the belt 437.

The rotation shaft of a fifth motor 433 is connected with the rotation shaft of the conveyance roller 36 by a one-way clutch 438 and a belt 440. When the fifth motor 433 rotates in a first rotational direction, the driving force of the fifth motor 433 is transmitted to the conveyance roller 36. On the other hand, when the fifth motor 433 rotates in a second rotational direction that is a direction opposite to the first rotational direction, the driving force of the fifth motor 433 is not transmitted to the conveyance roller 36.

The rotation shaft of the fifth motor 433 is connected with a gear 442 through a one-way clutch 441. When the fifth motor 433 rotates in the second rotational direction, the driving force of the fifth motor 433 is transmitted to the gear 442. The rotation shaft of the gear 442 is connected with the rotation shaft of a cam 443. As a result, when the fifth motor 433 rotates in the second rotational direction, the driving force of the fifth motor 433 is transmitted to the cam 443 through the one-way clutch 441 and the gear 442. On the other hand, when the fifth motor 433 rotates in the first rotational direction, the driving force of the fifth motor 433 is not transmitted to the cam 443.

As described above, in the present exemplary embodiment, when the fifth motor 433 rotates in the first rotational direction, the driving force of the fifth motor 433 is transmitted to the conveyance roller 36. When the fifth motor 433 rotates in the second rotational direction, the driving force of the fifth motor 433 is transmitted to the cam 443. The transfer roller pair 28 rotates by being driven by the rotation of the transfer belt 27.

The cam 443 according to the present exemplary embodiment has a shape illustrated in FIG. 4 and described in the first exemplary embodiment. When the cam 443 rotates, the outer peripheral surface of the cam 443 comes into contact with, for example, the rotation shaft of a second transfer roller 28*b*, and the rotation shaft of the second transfer roller 28*b* is displaced. Thus, the distance between the rotation shaft of the second transfer roller 28*b* and the rotation shaft of a first transfer roller 28*a* changes.

A home position sensor 444 detects that the rotational phase of the cam 443 is a predetermined phase (i.e., the cam 443 is located at a home position).

In the present exemplary embodiment, in the state where the cam 443 is located at the home position, the second transfer roller 28*b* is separate from the transfer belt 27. However, it is not limited thereto. For example, in the state where the cam 443 is located at the home position, the second transfer roller 28*b* may be in contact with the transfer belt 27. In this case, the cam 443 is rotated by a predetermined amount from the state where the cam 443 is located at the home position, whereby the second transfer roller 28*b* can be separated from the transfer belt 27. By using a configuration in which the second transfer roller 28*b* separates from the transfer belt 27, it is possible to easily remove jammed paper in the transfer roller pair 28.

When the rotation of the cam 443 is started from the state where the cam 443 is located at the home position, the rotation shaft of the second transfer roller 28*b* comes into contact with first, second, and third cam surfaces in this order. The first, second, and third cam surfaces are approximately flat surfaces. In the states where the first, second, and third cam surfaces are in contact with the rotation shaft of the second transfer roller 28*b*, even if the excitation of the fifth motor 433 is stopped, the cam 443 does not rotate. In other words, in the states where the first, second, and third cam surfaces are in contact with the rotation shaft of the second transfer roller 28*b*, even if the excitation of the fifth motor 433 is stopped, the rotational phase of the cam 443 is maintained, and the rotation shaft of the second transfer roller 28*b* is not displaced. As a result, even if the excitation of the fifth motor 433 is stopped, the distance between the rotation shaft of the second transfer roller 28*b* and the rotation shaft of the first transfer roller 28*a* can be maintained.

<Method for Driving Conveyance Roller>

Figure 10:
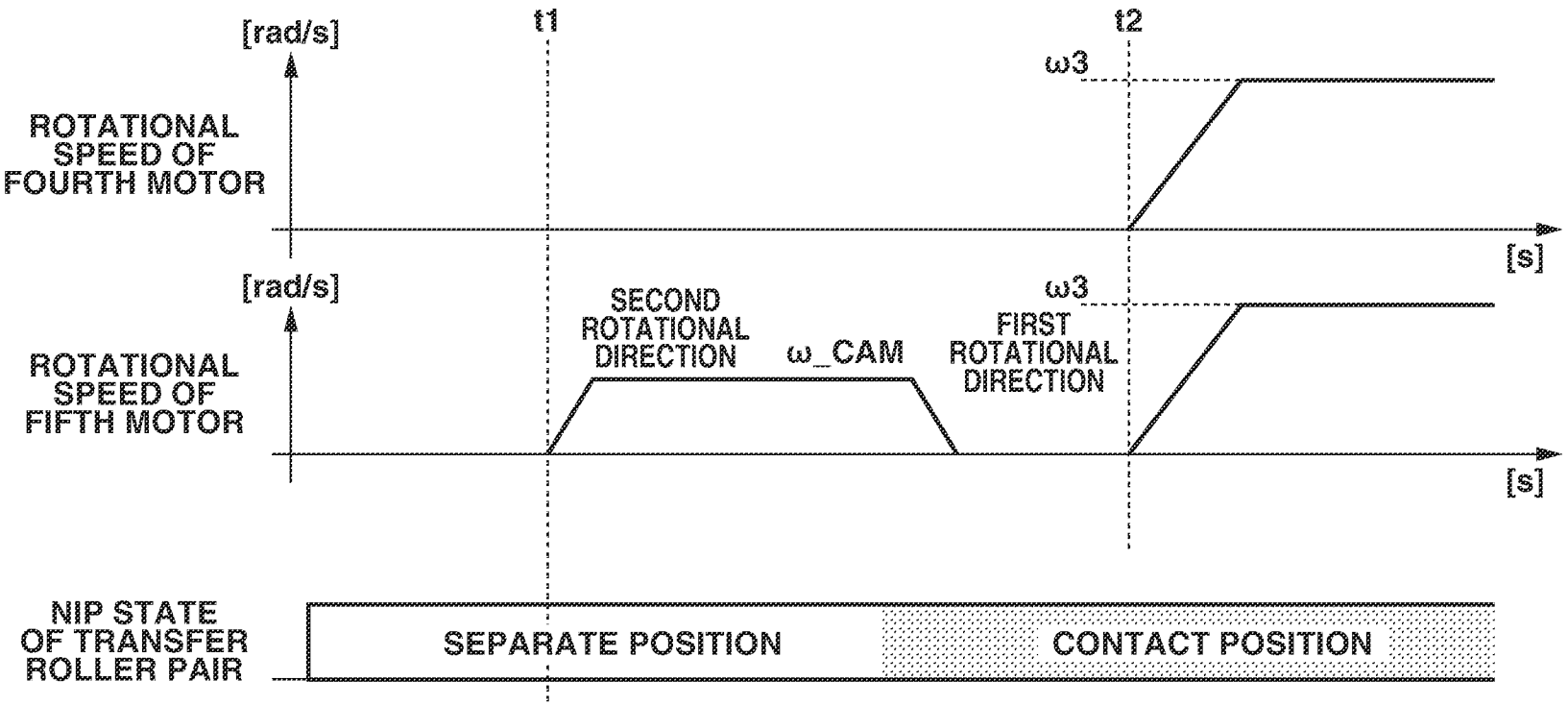
FIG. 10 is a timing chart illustrating a method for driving the conveyance rollers according to the second exemplary embodiment.

FIG. 10 is a timing chart illustrating a method for driving the conveyance roller 36. FIG. 10 illustrates the rotational speed of a rotor of the fourth motor 432, the rotational speed of a rotor of the fifth motor 433, and the nip state of the first transfer roller 28*a* and the second transfer roller 28*b*.

First, in the state where the transfer belt 27 is separate from the first transfer roller 28*a*, the CPU 151*a* outputs a predetermined speed ω_CAM as an instruction speed ω2_ref to the motor control device 167 so that the fifth motor 433 is driven at the predetermined speed ω_CAM in the first rotational direction for a predetermined time period (time t1). As a result, the transfer belt 27 comes into contact with the first transfer roller 28*a*. The predetermined time period is set to a time period required for the transfer belt 27 to come into contact with the first transfer roller 28*a*.

Then, the CPU 151*a* controls the motor control devices 166 and 167 so that the fourth motor 432 and the fifth motor 433 are driven at a third speed ω3 (time t2). As a result, the conveyance rollers 35 and 36 are driven at an angular speed corresponding to the third speed ω3 by the fourth motor 432 and the fifth motor 433. The third speed ω3 is a speed corresponding to the conveyance speed at which a sheet is conveyed, and the conveyance speed is set in advance based on the sequence of the image forming apparatus 100.

When the rotational speeds of the rotors of the fourth motor 432 and the fifth motor 433 reach the third speed ω3, the CPU 151*a* starts forming an image on a recording medium by the image printing apparatus 301.

When an image forming job ends, the CPU 151*a* rotates the fifth motor 433 until the home position sensor 444 detects that the cam 443 is located at the home position.

As described above, in the present exemplary embodiment, the conveyance roller 36 is driven using the fourth motor 432 for driving the conveyance roller 36, and the fifth motor 433 for adjusting the distance between the rotation shaft of the second transfer roller 28*b* and the rotation shaft of the first transfer roller 28*a*. In other words, in the present exemplary embodiment, the fifth motor 433 that is the motor for adjusting the distance between the rotation shaft of the second transfer roller 28*b* and the rotation shaft of the first transfer roller 28*a* is used also as a motor for driving the conveyance roller 36. As a result, it is possible to reduce cost as compared with a case where two dedicated motors for driving the conveyance roller 36 are used. In this way, it is possible to drive a load with a less expensive configuration.

In the present exemplary embodiment, the fifth motor 433 is connected with the conveyance roller 36 by the belt 440. Alternatively, for example, the fifth motor 433 may be connected with the conveyance roller 33 by a belt. In other words, when the fifth motor 433 rotates in the first rotational direction, the driving force of the fifth motor 433 may be transmitted to the conveyance roller 33 by a belt. Alternatively, the fifth motor 433 may be connected with both the conveyance roller 33 and the conveyance roller 36 by belts, and the driving force of the fifth motor 433 is transmitted to the conveyance rollers 33 and 36 by the belts.

Next, a third exemplary embodiment is described. Components of an image forming apparatus 100 according to the third exemplary embodiment that are similar to those of the image forming apparatus 100 according to the second exemplary embodiment are not described.

In the second exemplary embodiment, the driving force of the fifth motor 433 is transmitted to the conveyance roller 36 through the one-way clutch 438. In the present exemplary embodiment, the driving force of the fifth motor 433 is transmitted to the conveyance roller 36 through, for example, an electromagnetic clutch 438' instead of the one-way clutch 438, and the electromagnetic clutch 438' is controlled by the CPU 151*a*.

As described in the second exemplary embodiment, in a case where a recording medium having relatively large stiffness or grammage (e.g., thick paper) is conveyed, a load torque applied to conveyance rollers that convey the recording medium passing through a curved conveyance path is much greater than a load torque applied to conveyance rollers that convey the recording medium passing through a horizontal conveyance path. Accordingly, in the present exemplary embodiment, according to the type of sheet to be conveyed, the CPU 151*a* determines whether to transmit the driving force of the fifth motor 433 to the conveyance roller 36. More specifically, according to the type of sheet to be conveyed, the CPU 151*a* determines whether to drive the conveyance rollers 36 using the fourth motor 432 or drive the conveyance roller 36 using both the fourth motor 432 and the fifth motor 433.

<Method for Driving Conveyance Roller>

Figure 11:
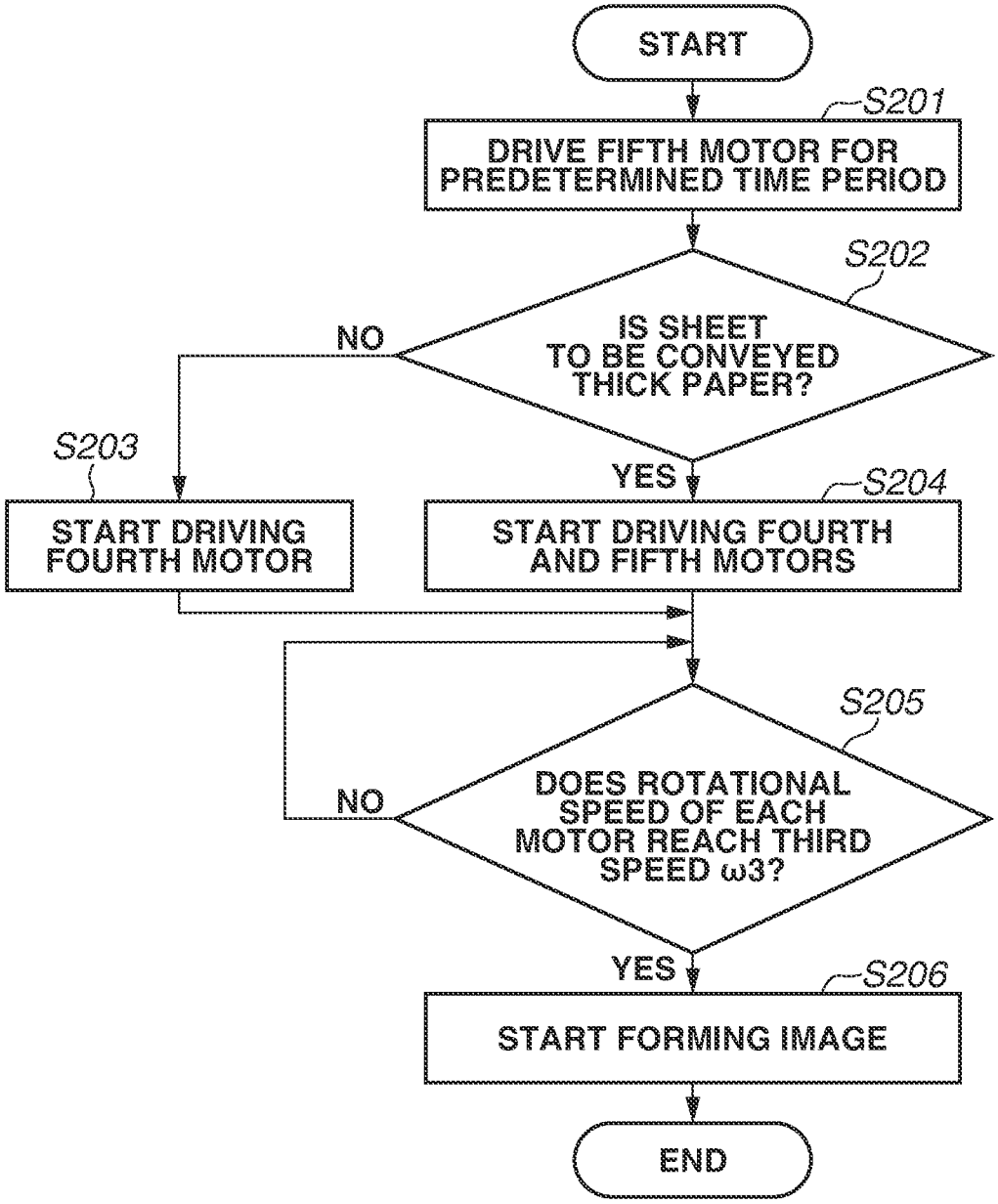
FIG. 11 is a flowchart illustrating a method for driving conveyance rollers according to a third exemplary embodiment.

FIG. 11 is a flowchart illustrating a method for driving the conveyance roller 36. With reference to FIG. 11, the method for driving the conveyance roller 36 is described. The processing of this flowchart is executed by the CPU 151*a*. The processing of this flowchart is executed when a job for forming an image is started. Before the processing of this flowchart is started, the transfer belt 27 is separate from the first transfer roller 28*a*, and the electromagnetic clutch 438' is in the off state. The on state of the electromagnetic clutch 438' corresponds to the state where the driving force of the fifth motor 433 is transmitted to the conveyance roller 36. The off state of the electromagnetic clutch 438' corresponds to the state where the driving force of the fifth motor 433 is not transmitted to the conveyance roller 36. In the following description, thin paper, plain paper, and thick paper can be conveyed as a recording medium by the image forming apparatus 100.

When the job for forming an image is started, then in step S201, the CPU 151*a* controls the motor control device 167 so that the fifth motor 433 rotates at the predetermined speed ω_CAM in the second rotational direction for a predetermined time period. As a result, the transfer belt 27 comes into contact with the first transfer roller 28*a*.

Next, in step S202, if the recording medium to be conveyed is not thick paper (NO in step S202), then in step S203, the CPU 151*a* controls the motor control device 166 so that the fourth motor 432 rotates at the third speed ω3. In the present exemplary embodiment, the CPU 151*a* acquires information regarding the paper type set by using the operation unit 152 by the user. However, it is not limited thereto. For example, the CPU 151*a* may acquire information regarding the paper type detected by a sensor provided in a conveyance path through which the recording medium is conveyed, or may acquire information regarding the paper type based on a load torque applied to a motor for driving the conveyance roller.

Then, in step S205, when the rotational speed of the rotor of the fourth motor 432 reaches the third speed ω3 (YES in step S205), then in step S206, the CPU 151*a* starts forming an image on the recording medium by the image printing apparatus 301.

On the other hand, in step S202, if the recording medium to be conveyed is thick paper (YES in step S202), then in step S204, the CPU 151*a* controls the motor control devices 166 and 167 so that the fourth motor 432 and the fifth motor 433 rotate at the third speed ω3.

Then, in step S205, when the rotational speed of the rotor of the fourth motor 432 and the rotational speed of the rotor of the fifth motor 433 reach the third speed ω3 (YES in step S205), then in step S206, the CPU 151*a* starts forming an image on the recording medium by the image printing apparatus 301.

As described above, in the present exemplary embodiment, according to the type of sheet to be conveyed, the CPU 151*a* determines whether to drive the conveyance roller 36 using the fourth motor 432 or drive the conveyance roller 36 using both the fourth motor 432 and the fifth motor 433. More specifically, in a case where the recording medium to be conveyed is thick paper, the conveyance roller 36 is driven using the fourth motor 432 for driving the conveyance roller 36, and the fifth motor 433 that is the motor for adjusting the distance between the rotation shaft of the second transfer roller 28*b* and the rotation shaft of the first transfer roller 28*a*. On the other hand, in a case where the recording medium to be conveyed is not thick paper, the conveyance roller 36 is driven by using the fourth motor 432 for driving the conveyance roller 36. As a result, in a case where the recording medium to be conveyed is not thick paper, it is possible to prevent an increase in power consumption.

Now, a fourth exemplary embodiment is described. Components of an image forming apparatus 100 according to the fourth exemplary embodiment that are similar to those of the image forming apparatus 100 according to the first exemplary embodiment are not described.

[Curl Correction Mechanism]

Figure 12:
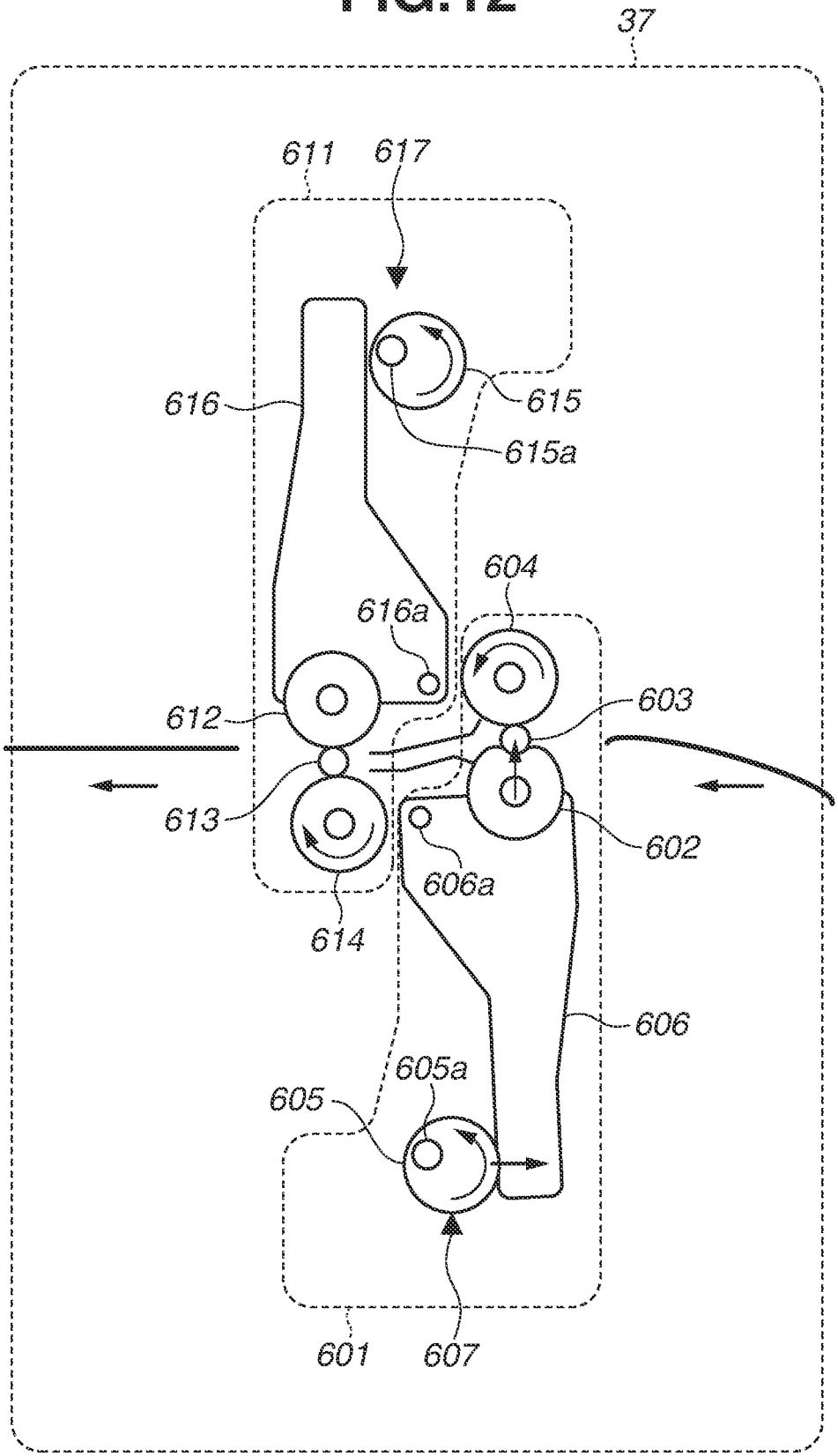
FIG. 12 is a diagram illustrating a configuration of a curl correction mechanism.

FIG. 12 is a diagram illustrating a configuration of the curl correction mechanism 37. The curl correction mechanism 37 includes an upstream-side curl correction mechanism 601 and a downstream-side curl correction mechanism 611.

In the upstream-side curl correction mechanism 601, a recording medium passes through a nip portion formed by a pressure roller 602 and a conveyance roller 603, thereby correcting a curl on the lower side having occurred in the recording medium as illustrated in FIG. 12. In the downstream-side curl correction mechanism 611, the recording medium passes through a nip portion formed by a pressure roller 612 and a conveyance roller 613, thereby correcting a curl on the upper side having occurred in the recording medium.

The conveyance roller 603 rotates by being driven by a roller 604 rotationally driven by a sixth motor 621 (described below). The pressure roller 602 rotates by being driven by the conveyance roller 603. The conveyance roller 613 rotates by being driven by a roller 614 rotationally driven by the sixth motor 621 (described below). The pressure roller 612 rotates by being driven by the conveyance roller 613.

The amount of correction of a curl by the curl correction mechanism 37 is adjusted according to the type of sheet to be conveyed. The amount of correction of a curl by the curl correction mechanism 37 is adjusted by adjusting the distance between the rotation shaft of the pressure roller 602 and the rotation shaft of the conveyance roller 603. The distance between the rotation shaft of the pressure roller 602 and the rotation shaft of the conveyance roller 603 is adjusted as follows. Specifically, a cam 605 rotates about a rotation shaft 605*a*, whereby an arm member 606 is pressed by the cam 605 and rotates about a rotation shaft 606*a*. As a result, the arm member 606 presses the pressure roller 602, and the pressure roller 602 moves toward the conveyance roller 603. As a result, the distance between the rotation shaft of the pressure roller 602 and the rotation shaft of the conveyance roller 603 changes.

As described above, the distance between the rotation shaft of the pressure roller 602 and the rotation shaft of the conveyance roller 603 (i.e., amount of correction of a curl by the curl correction mechanism 37) is adjusted by adjusting the amount of rotation of the cam 605.

<Driving Configuration of Rollers>

Figure 13:
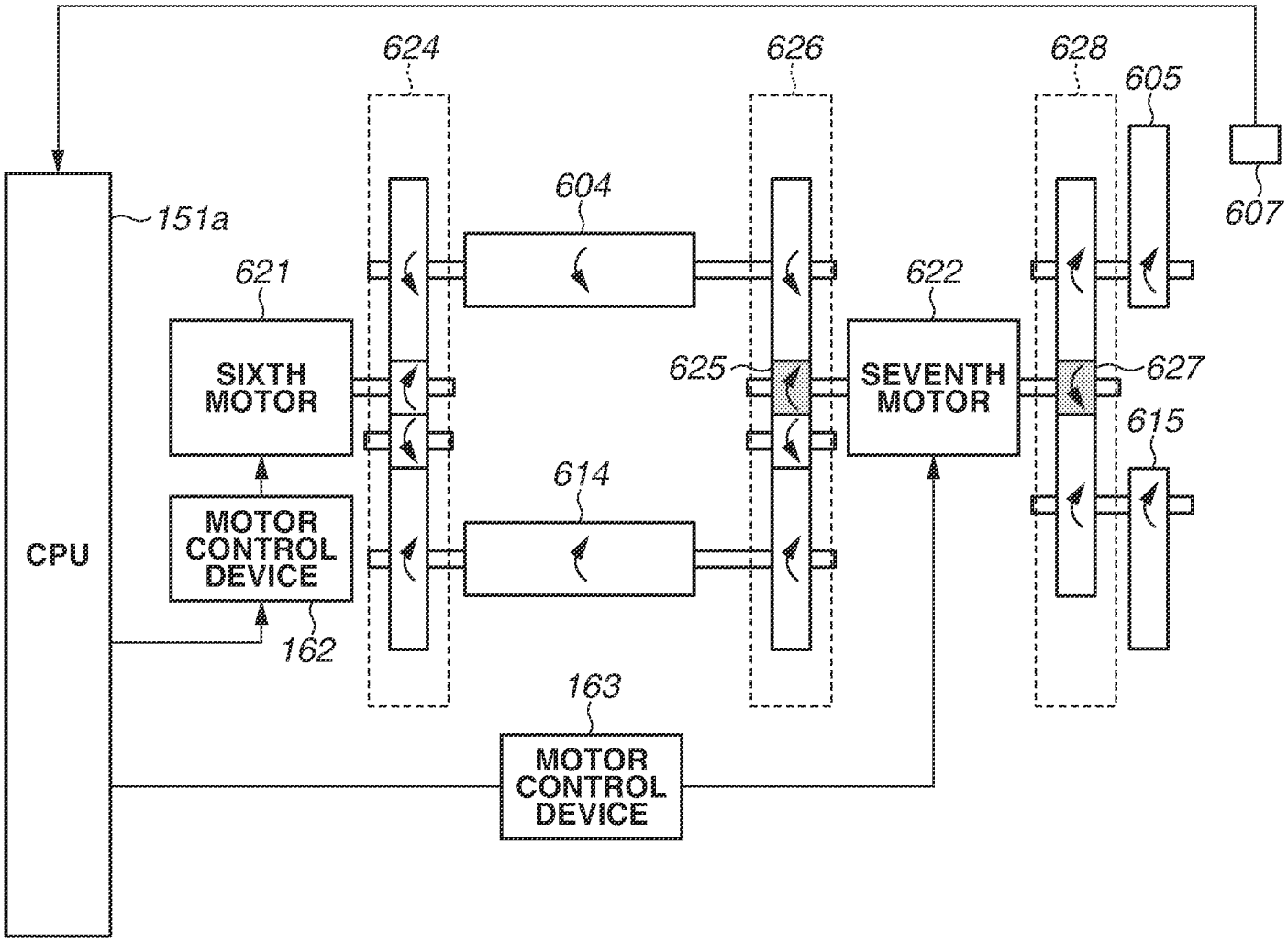
FIG. 13 is a diagram illustrating a driving configuration of conveyance rollers according to a fourth exemplary embodiment.

FIG. 13 is a diagram illustrating a driving configuration of the conveyance rollers. Arrows illustrated in FIG. 13 indicate the rotational directions of rotating members. The configurations of motor control devices 162 and 163 are similar to the configuration of the motor control device 157 according to the first exemplary embodiment, and therefore are not described.

The driving force of a sixth motor 621 is transmitted to the rollers 604 and 614 by a drive transmission mechanism 624 that includes gears.

As illustrated in FIG. 13, a seventh motor 622 is connected with the rollers 604 and 614 by a drive transmission mechanism 626 that includes a one-way clutch 625. When the seventh motor 622 rotates in a first rotational direction, the driving force of the seventh motor 622 is transmitted to the rollers 604 and 614. On the other hand, when the seventh motor 622 rotates in a second rotational direction that is a direction opposite to the first rotational direction, the driving force of the seventh motor 622 is not transmitted to the rollers 604 and 614.

As illustrated in FIG. 13, the seventh motor 622 is also connected with the cam 605 and a cam 615 through a drive transmission mechanism 628 that includes a one-way clutch 627. When the seventh motor 622 rotates in the second rotational direction, the driving force of the seventh motor 622 is transmitted to the cams 605 and 615. On the other hand, when the seventh motor 622 rotates in the first rotational direction, the driving force of the seventh motor 622 is not transmitted to the cams 605 and 615.

As described above, in the present exemplary embodiment, when the seventh motor 622 rotates in the first rotational direction, the driving force of the seventh motor 622 is transmitted to the rollers 604 and 614. When the seventh motor 622 rotates in the second rotational direction, the driving force of the seventh motor 622 is transmitted to the cams 605 and 615.

The cam 605 according to the present exemplary embodiment has a shape illustrated in FIG. 4 and described in the first exemplary embodiment. If the cam 605 rotates, the outer peripheral surface of the cam 605 comes into contact with the arm member 606.

A home position sensor 607 detects that the rotational phase of the cam 605 is a predetermined phase (cam 605 is located at a home position).

In the present exemplary embodiment, the distance between the rotation shaft of the pressure roller 602 and the rotation shaft of the conveyance roller 603 in the state where the cam 605 is located at the home position is a predetermined distance.

When the rotation of the cam 605 is started from the state where the cam 605 is located at the home position, the arm member 606 comes into contact with first, second, and third cam surfaces in this order. The first, second, and third cam surfaces are approximately flat surfaces. In the states where the first, second, and third cam surfaces are in contact with the rotation shaft of the arm member 606, even if the excitation of the seventh motor 622 is stopped, the cam 605 does not rotate. In other words, in the states where the first, second, and third cam surfaces are in contact with the arm member 606, even if the excitation of the seventh motor 622 is stopped, the rotation shaft of the pressure roller 602 is not displaced. As a result, even if the excitation of the seventh motor 622 is stopped, the distance between the rotation shaft of the pressure roller 602 and the rotation shaft of the conveyance roller 603 can be maintained.

The configuration of the cam 615 is similar to that of the cam 605, and therefore is not described. The configuration of the downstream-side curl correction mechanism 611 is similar to the configuration of the upstream-side curl correction mechanism 601, and therefore is not described.

<Method for Driving Rollers>

A conveyance path provided within the curl correction mechanism 37 is curved. As described in the second exemplary embodiment, a load torque applied to conveyance rollers that convey a recording medium to a curved conveyance path is greater than a load torque applied to conveyance rollers that convey the recording medium to a horizontal conveyance path. In the present exemplary embodiment, the following configuration is applied, thereby driving the conveyance rollers as a load with a less expensive configuration.

Figure 14:
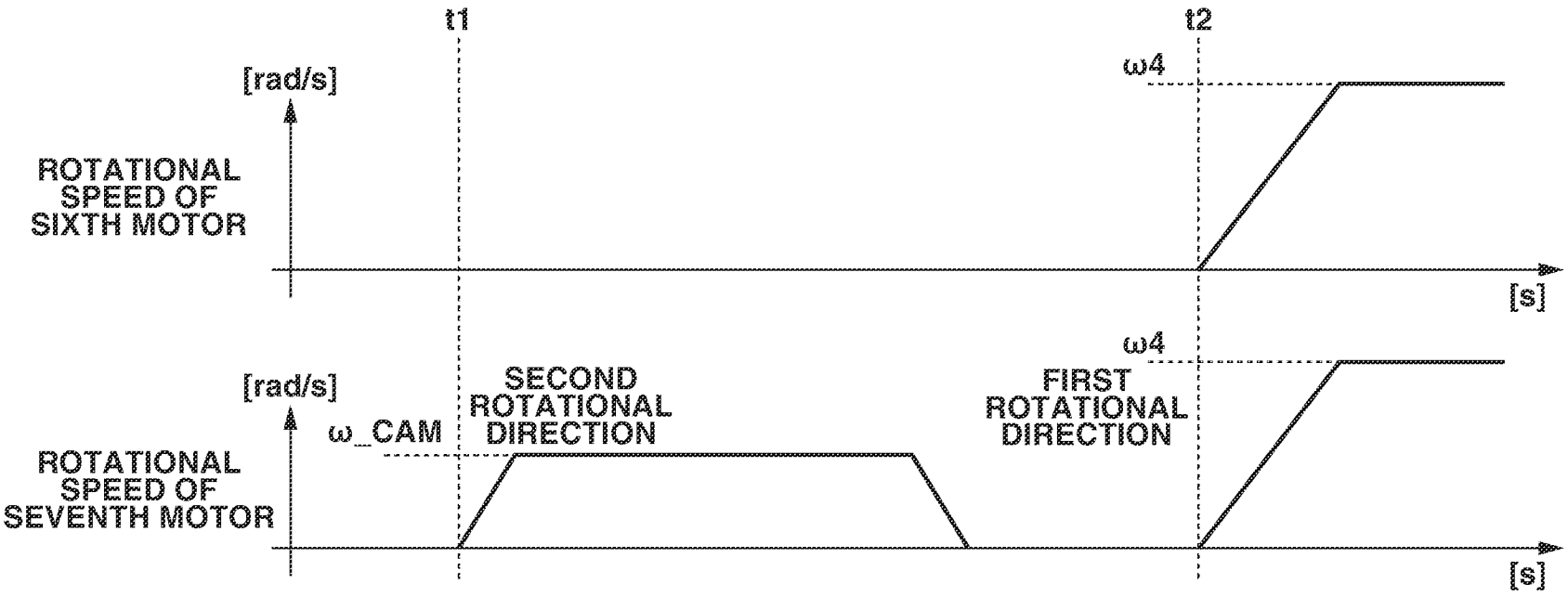
FIG. 14 is a timing chart illustrating a method for driving rollers according to the fourth exemplary embodiment.

FIG. 14 is a timing chart illustrating a method for driving the rollers 604 and 614. FIG. 14 illustrates the rotational speed of a rotor of the sixth motor 621 and the rotational speed of a rotor of the seventh motor 622.

First, the CPU 151*a* outputs a predetermined speed ω_CAM as an instruction speed ω2_ref to the motor control device 163 so that the seventh motor 622 is driven at the predetermined speed ω_CAM in the second rotational direction for a predetermined time period (time t1). As a result, the pressure at the nip portion formed by the pressure roller 602 (612) and the conveyance roller 603 (613) is adjusted. The predetermined time period is set to a time period required for the pressure at the nip portion formed by the pressure roller 602 (612) and the conveyance roller 603 (613) to become predetermined pressure.

Then, the CPU 151*a* controls the motor control devices 162 and 163 so that the sixth motor 621 and the seventh motor 622 are driven at a fourth speed ω4 (time t2). As a result, the rollers 604 and 614 are driven at an angular speed corresponding to the fourth speed ω4. The fourth speed ω4 is a speed corresponding to the conveyance speed at which a sheet is conveyed, and the conveyance speed is set in advance based on the sequence of the image forming apparatus 100.

If the rotational speeds of the rotors of the sixth motor 621 and the seventh motor 622 reach the fourth speed ω4, the CPU 151*a* starts forming an image on a recording medium by the image printing apparatus 301.

If an image forming job ends, the CPU 151*a* rotates the seventh motor 622 until the home position sensor 607 detects that the cam 605 is located at the home position. As a result, the cam 605 (615) is located at the home position.

As described above, in the present exemplary embodiment, the rollers 604 and 614 are driven using the sixth motor 621 for driving the rollers 604 and 614, and the seventh motor 622 that is a motor for adjusting the distance between the rotation shaft of the pressure roller 602 and the rotation shaft of the conveyance roller 603. In other words, in the present exemplary embodiment, the seventh motor 622 that is the motor for adjusting the distance between the rotation shaft of the pressure roller 602 and the rotation shaft of the conveyance roller 603 is used also as a motor for driving the rollers 604 and 614. As a result, it is possible to reduce cost as compared with a case where two dedicated motors for driving the rollers 604 and 614 are used. Therefore, it is possible to drive a load with a less expensive configuration.

A fifth exemplary embodiment is described. Components of an image forming apparatus 100 according to the fifth exemplary embodiment that are similar to those of the image forming apparatus 100 according to the fourth exemplary embodiment are not described.

In the fourth exemplary embodiment, the driving force of the seventh motor 622 is transmitted to the rollers 604 and 614 through the one-way clutch 625. In the present exemplary embodiment, the driving force of the seventh motor 622 is transmitted to the rollers 604 and 614 through, for example, an electromagnetic clutch 625' instead of the one-way clutch 625, and the electromagnetic clutch 625' is controlled by the CPU 151*a*.

In the present exemplary embodiment, according to the type of sheet to be conveyed, the CPU 151*a* determines whether to transmit the driving force of the seventh motor 622 to the rollers 604 and 614. In other words, according to the type of sheet to be conveyed, the CPU 151*a* determines whether to drive the rollers 604 and 614 using the sixth motor 621 or drive the rollers 604 and 614 using both the sixth motor 621 and the seventh motor 622.

<Method for Driving Rollers>

Figure 15:
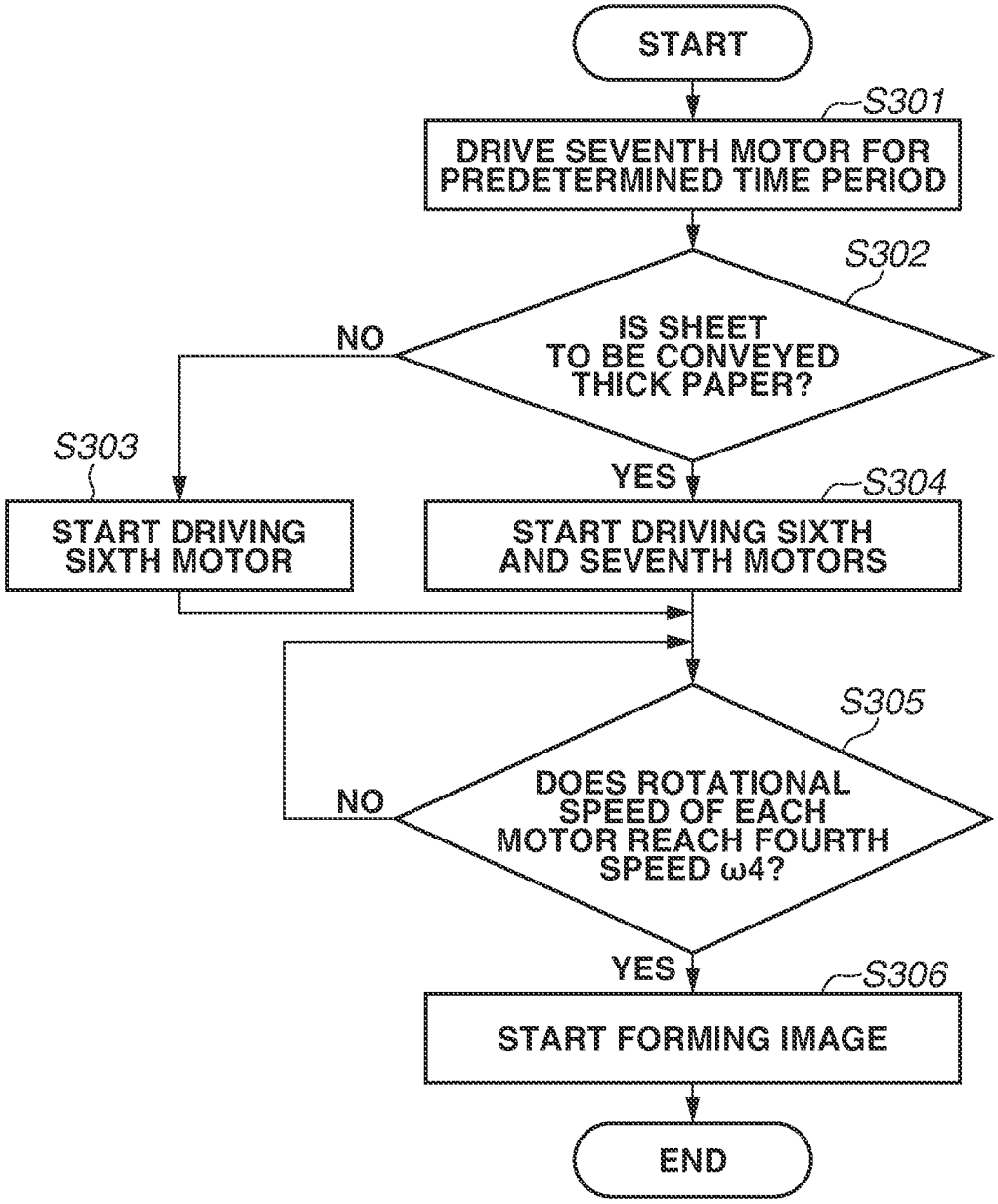
FIG. 15 is a flowchart illustrating a method for driving rollers according to a fifth exemplary embodiment.

FIG. 15 is a flowchart illustrating a method for driving the rollers 604 and 614. With reference to FIG. 15, the method for driving the rollers 604 and 614 is described. The processing of this flowchart is executed by the CPU 151*a*. The processing of this flowchart is executed when a job for forming an image is started. The on state of the electromagnetic clutch 625' corresponds to the state where the driving force of the seventh motor 622 is transmitted to the rollers 604 and 614. The off state of the electromagnetic clutch 625' corresponds to the state where the driving force of the seventh motor 622 is not transmitted to the rollers 604 and 614. In the following description, thin paper, plain paper, and thick paper can be conveyed as a recording medium by the image forming apparatus 100.

If the job for forming an image is started, then in step S301, the CPU 151*a* controls the motor control device 163 so as to rotate the seventh motor 622 at the predetermined speed ω_CAM in the second rotational direction for a predetermined time period. As a result, the pressure force of the pressure roller 602 against the conveyance roller 603 is adjusted.

Next, in step S302, if the recording medium to be conveyed is not thick paper (NO in step S302), then in step S303, the CPU 151*a* controls the motor control device 162 so as to rotate the sixth motor 621 at the fourth speed ω4. In the present exemplary embodiment, the CPU 151*a* acquires information regarding the paper type set using the operation unit 152 by the user. However, it is not limited to this. For example, the CPU 151*a* may acquire information regarding the paper type detected by a sensor provided on a conveyance path through which the recording medium is conveyed, or may acquire information regarding the paper type based on a load torque applied to a motor for driving conveyance rollers.

Then, in step S305, if the rotational speed of the rotor of the sixth motor 621 reaches the fourth speed ω4 (YES in step S305), then in step S306, the CPU 151*a* starts forming an image on the recording medium by the image printing apparatus 301.

On the other hand, in step S302, if the recording medium to be conveyed is thick paper (YES in step S302), then in step S304, the CPU 151*a* controls the motor control devices 162 and 163 so as to rotate the sixth motor 621 and the seventh motor 622 at the fourth speed ω4.

Then, in step S305, if the rotational speed of the rotor of the sixth motor 621 and the rotational speed of the rotor of the seventh motor 622 reach the fourth speed ω4 (YES in step S305), then in step S306, the CPU 151*a* starts forming an image on the recording medium by the image printing apparatus 301.

As described above, in the present exemplary embodiment, depending on the type of sheet to be conveyed, the CPU 151*a* determines whether to drive the rollers 604 and 614 using the sixth motor 621 or drive the rollers 604 and 614 using both the sixth motor 621 and the seventh motor 622. More specifically, in a case where the recording medium to be conveyed is thick paper, the rollers 604 and 614 are driven using the sixth motor 621 for driving the rollers 604 and 614, and the seventh motor 622 that is the motor for adjusting the distance between the rotation shaft of the pressure roller 602 and the rotation shaft of the conveyance roller 603. On the other hand, in a case where the recording medium to be conveyed is not thick paper, the rollers 604 and 614 are driven using the sixth motor 621 for driving the rollers 604 and 614. As a result, in a case where the recording medium to be conveyed is not thick paper, it is possible to prevent an increase in power consumption.

In the present exemplary embodiment, depending on the type of sheet to be conveyed, it is determined whether to drive the rollers 604 and 614 using the sixth motor 621 or drive the rollers 604 and 614 using both the sixth motor 621 and the seventh motor 622. However, it is not limited to this. For example, according to the pressure force of the pressure roller 602 against the conveyance roller 603 that is set depending on the paper type, it may be determined whether to drive the rollers 604 and 614 using the sixth motor 621 or drive the rollers 604 and 614 using both the sixth motor 621 and the seventh motor 622. More specifically, if the pressure force is a first pressure force, the rollers 604 and 614 may be driven using the sixth motor 621 for driving the rollers 604 and 614. On the other hand, if the pressure force is a second pressure force that is greater than the first pressure force, the rollers 604 and 614 may be driven using the sixth motor 621 for driving the rollers 604 and 614, and the seventh motor 622 that is the motor for adjusting the distance between the rotation shaft of the pressure roller 602 and the rotation shaft of the conveyance roller 603.

<Variations of Driving Configuration of Rollers>

Figure 16:
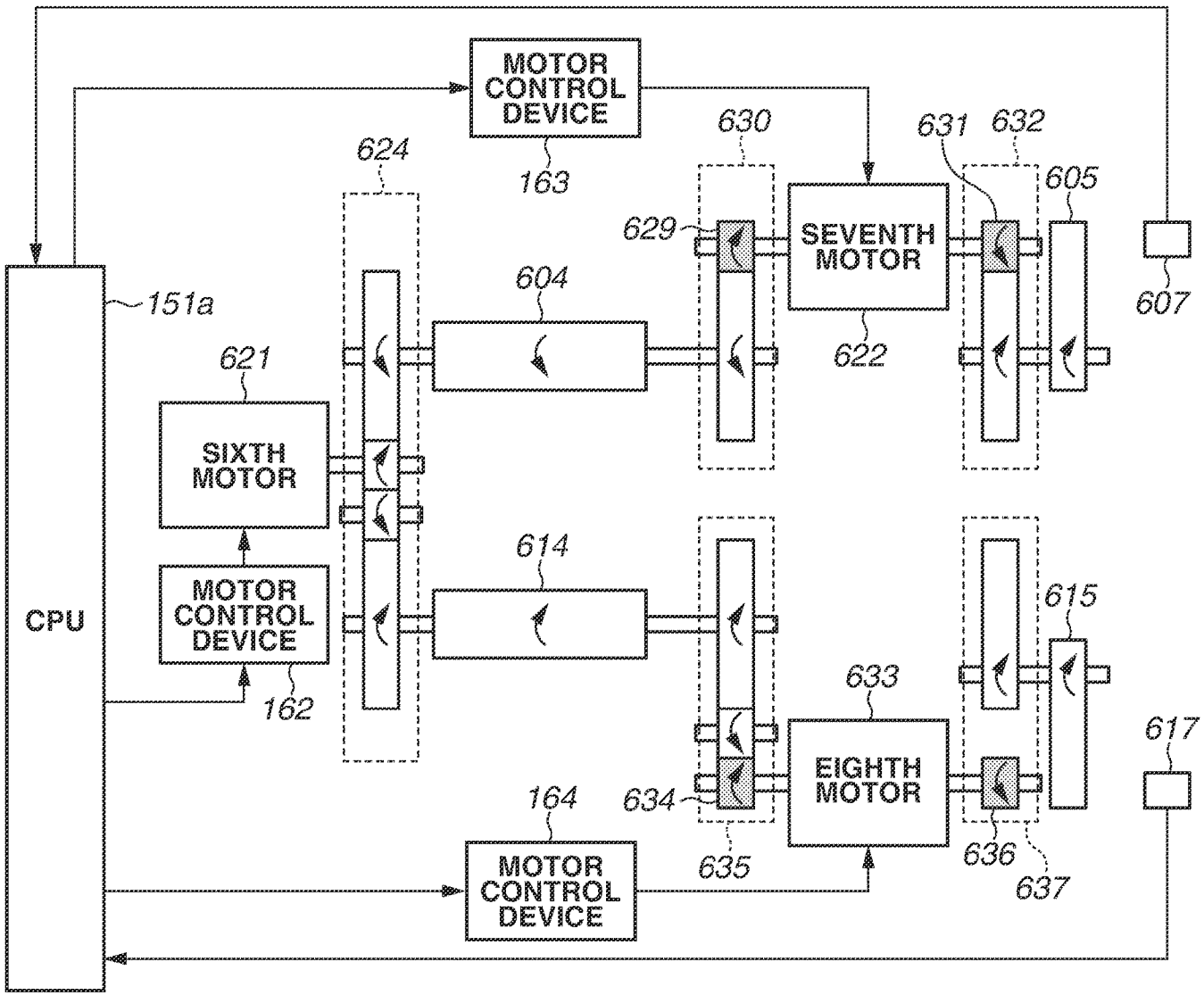
FIG. 16 is a diagram illustrating a variation of the driving configuration of conveyance rollers.

In the fourth and fifth exemplary embodiments, the rollers 604 and 614 and the cams 605 and 615 are driven by the seventh motor 622. However, it is not limited to this. For example, as illustrated in FIG. 16, a seventh motor for driving the roller 604 and the cam 605 and an eighth motor for driving the roller 614 and the cam 615 may be provided.

More specifically, the seventh motor 622 is connected with the roller 604 by a drive transmission mechanism 630 that includes a one-way clutch 629. If the seventh motor 622 rotates in a first rotational direction, the driving force of the seventh motor 622 is transmitted to the roller 604. On the other hand, if the seventh motor 622 rotates in a second rotational direction opposite to the first rotational direction, the driving force of the seventh motor 622 is not transmitted to the roller 604. The seventh motor 622 is also connected with the cam 605 through a drive transmission mechanism 632 that includes a one-way clutch 631. If the seventh motor 622 rotates in the second rotational direction, the driving force of the seventh motor 622 is transmitted to the cam 605. On the other hand, if the seventh motor 622 rotates in the first rotational direction, the driving force of the seventh motor 622 is not transmitted to the cam 605. As described above, if the seventh motor 622 rotates in the first rotational direction, the driving force of the seventh motor 622 is transmitted to the roller 604. If the seventh motor 622 rotates in the second rotational direction, the driving force of the seventh motor 622 is transmitted to the cam 605.

Further, an eighth motor 633 is connected with the roller 614 by a drive transmission mechanism 635 that includes a one-way clutch 634. If the eighth motor 633 rotates in a first rotational direction, the driving force of the eighth motor 633 is transmitted to the roller 614. On the other hand, if the eighth motor 633 rotates in a second rotational direction that is opposite to the first rotational direction, the driving force of the eighth motor 633 is not transmitted to the roller 614. The eighth motor 633 is connected with the cam 615 through a drive transmission mechanism 637 that includes a one-way clutch 636. If the eighth motor 633 rotates in the second rotational direction, the driving force of the eighth motor 633 is transmitted to the cam 615. On the other hand, if the eighth motor 633 rotates in the first rotational direction, the driving force of the eighth motor 633 is not transmitted to the cam 615. As described above, if the eighth motor 633 rotates in the first rotational direction, the driving force of the eighth motor 633 is transmitted to the roller 614. If the eighth motor 633 rotates in the second rotational direction, the driving force of the eighth motor 633 is transmitted to the cam 615.

A sixth exemplary embodiment is described. Components of an image forming apparatus 100 according to the sixth exemplary embodiment that are similar to those of the image forming apparatus 100 according to the first exemplary embodiment are not described.

In the present exemplary embodiment, a motor is controlled by vector control.

<Vector Control>

Figure 17:
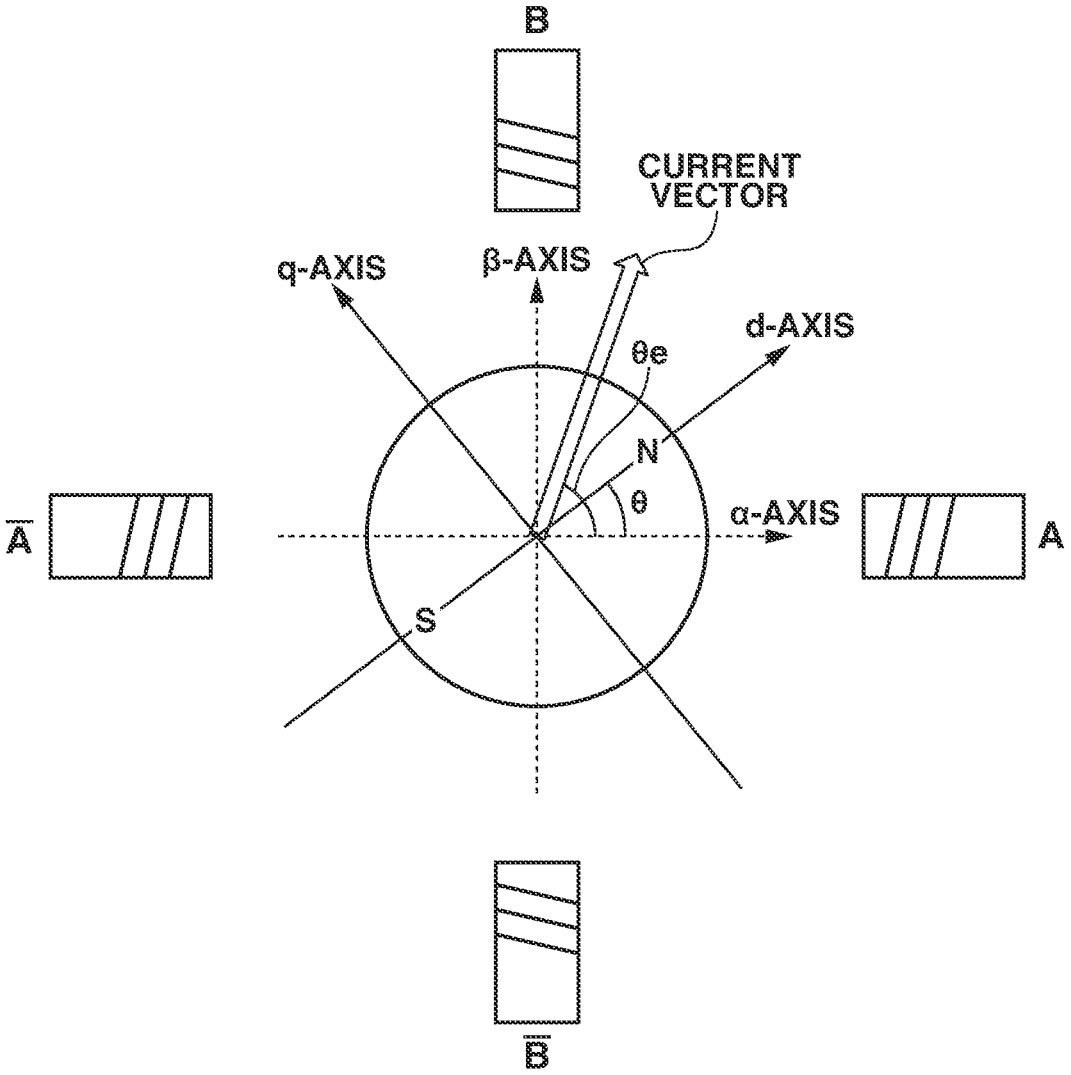
FIG. 17 is a diagram illustrating a relationship between a first motor having two phases including an A-phase (first phase) and a B-phase (second phase), and a rotating coordinate system represented by a d-axis and a q-axis.
Figure 18:
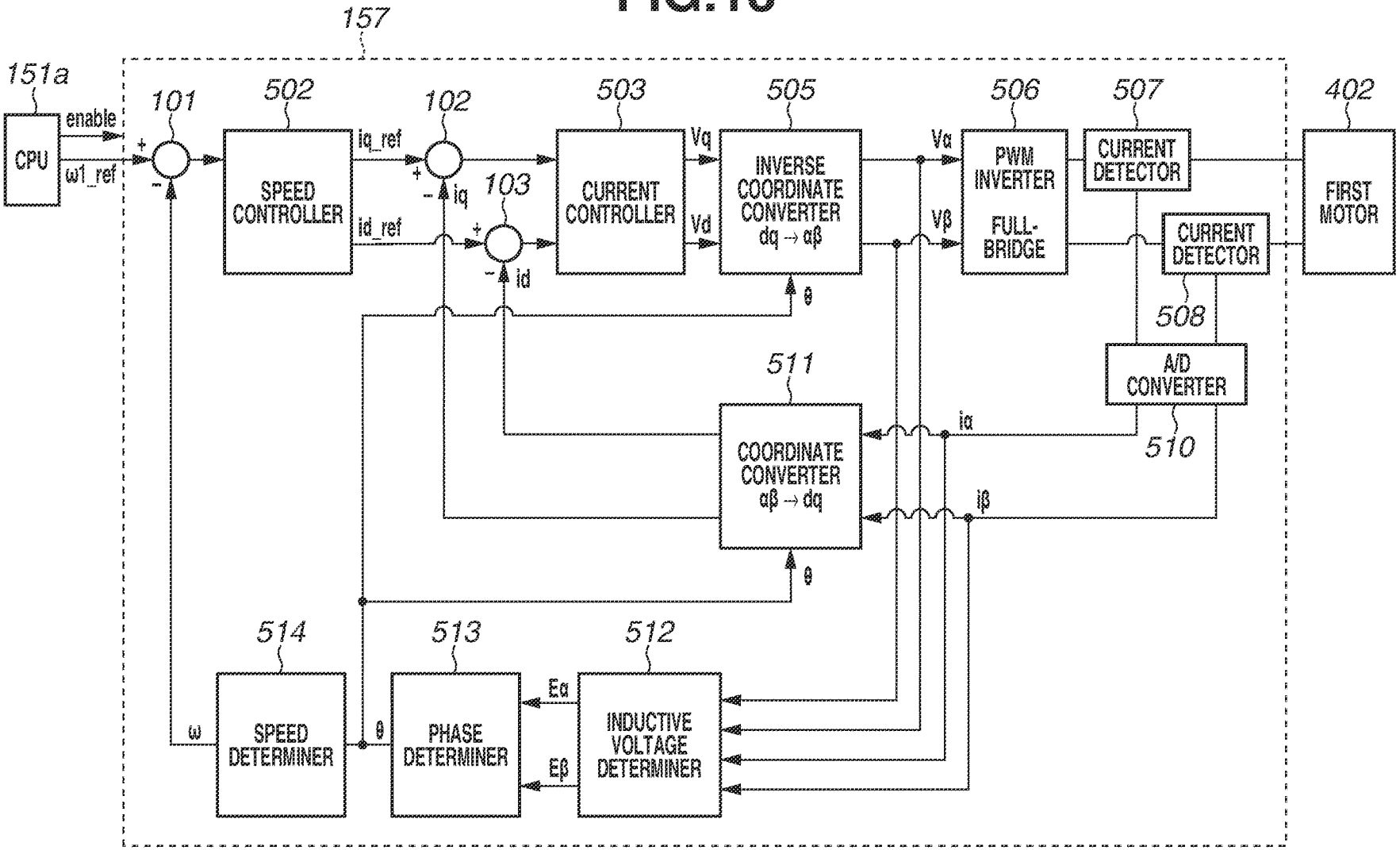
FIG. 18 is a block diagram illustrating an example of a configuration of a motor control device according to a sixth exemplary embodiment.

With reference to FIGS. 17 and 18, a description is given of a method in which the motor control device 157 performs vector control, according to the present exemplary embodiment. In a motor in the following description, a sensor such as a rotary encoder for detecting the rotational phase of a rotor of the motor is not provided. However, a configuration may be employed in which a sensor such as a rotary encoder is provided in the motor. Although a control configuration of the first motor 402 is described below, the control configurations of the second motor 403, the third motor 431, the fourth motor 432, the fifth motor 433, the sixth motor 621, the seventh motor 622, and the eighth motor 633 are similar to the control configuration of the first motor 402.

FIG. 17 is a diagram illustrating a relationship between a stepping motor as the first motor 402 having two phases of an A-phase (first phase) and a B-phase (second phase), and a rotating coordinate system represented by a d-axis and a q-axis. In FIG. 17, in a stationary coordinate system, an a-axis, which is an axis corresponding to coils in the A-phase, and a β-axis, which is an axis corresponding to coils in the B-phase, are defined. In FIG. 17, the d-axis is defined along the direction of the magnetic flux generated by the magnetic poles of a permanent magnet used for a rotor, and the q-axis is defined along a direction rotated 90 degrees counterclockwise from the d-axis (direction orthogonal to d-axis). The angle between the α-axis and the d-axis is defined as θ, and the rotational phase of the rotor is represented by the angle θ. In the vector control, a rotating coordinate system using the rotational phase θ of the rotor as a reference is used. More specifically, in the vector control, a q-axis component (torque current component) and a d-axis component (excitation current component), which are current components in the rotating coordinate system of a current vector corresponding to a driving current flowing through each coil, are used. The q-axis component (torque current component) generates a torque in the rotor, and the d-axis component (excitation current component) influences the strength of the magnetic flux passing through the coil.

The vector control is a control method for controlling a motor by performing speed feedback control for controlling the value of a torque current component and a value of an excitation current component so that the deviation between an instruction speed indicating the target speed of a rotor and the actual rotational speed of the rotor becomes small. There is also a method for controlling a motor by performing phase feedback control for controlling the value of a torque current component and the value of an excitation current component so that the deviation between an instruction phase indicating the target phase of a rotor and the actual rotational phase of the rotor becomes small.

FIG. 18 is a block diagram illustrating an example of a configuration of the motor control device 157. The motor control device 157 includes at least one ASIC or executes functions described below.

As illustrated in FIG. 18, the motor control device 157 includes, as a circuit for performing the vector control, a speed controller 502, a current controller 503, an inverse coordinate converter 505, a coordinate converter 511, and a PWM inverter 506. The coordinate converter 511 performs coordinate conversion on current vectors corresponding to driving currents flowing through the coils for the A-phase and the B-phase of the first motor 402, from the stationary coordinate system represented by the a-axis and the β-axis to the rotating coordinate system represented by the q-axis and the d-axis. As a result, the driving currents flowing through the coils are represented by the current value of the q-axis component (q-axis current) and the current value of the d-axis component (d-axis current), which are current values in the rotating coordinate system. The q-axis current corresponds to a torque current that generates a torque in the rotor of the first motor 402. The d-axis current corresponds to an excitation current that influences the strength of the magnetic flux passing through each coil of the first motor 402. The motor control device 157 can independently control the q-axis current and the d-axis current. As a result, the motor control device 157 controls the q-axis current according to a load torque applied to the rotor and thereby can efficiently generate a torque required for the rotation of the rotor. Thus, in the vector control, the magnitude of the current vector illustrated in FIG. 17 changes according to the load torque applied to the rotor.

The motor control device 157 determines a rotational speed w of the rotor of the first motor 402 using a method described below, and based on the determination result, performs the vector control. The CPU 151*a* generates an instruction speed ω1_ref representing the target speed of the rotor of the first motor 402 and outputs the instruction speed ω1_ref to the motor control device 157.

A subtractor 101 calculates the deviation between the rotational speed w of the rotor of the first motor 402 and the instruction speed ω1_ref and outputs the calculated deviation to the speed controller 502.

The speed controller 502 acquires the deviation output from the subtractor 101 at a predetermined time period T (e.g., 200 μs). Based on proportional control (P), integral control (I), and derivative control (D), the speed controller 502 generates a q-axis current instruction value iq_ref and a d-axis current instruction value id_ref so that the deviation output from the subtractor 101 becomes small. Then, the speed controller 502 outputs the q-axis current instruction value iq_ref and the d-axis current instruction value id_ref. More specifically, based on the P-control, the I-control, and the D-control, the speed controller 502 generates the q-axis current instruction value iq_ref and the d-axis current instruction value id_ref so that the deviation output from the subtractor 101 becomes 0. Then, the speed controller 502 outputs the q-axis current instruction value iq_ref and the d-axis current instruction value id_ref. The P-control is a control method for controlling the value of a target to be controlled, based on a value proportional to the deviation between an instruction value and an estimated value. The I-control is a control method for controlling the value of the target to be controlled, based on a value proportional to the time integral of the deviation between the instruction value and the estimated value. The D-control is a control method for controlling the value of the target to be controlled, based on a value proportional to a change over time in the deviation between the instruction value and the estimated value. The speed controller 502 according to the present exemplary embodiment generates the q-axis current instruction value iq_ref and the d-axis current instruction value id_ref based on the PID control. However, it is not limited to this. For example, the speed controller 502 may generate the q-axis current instruction value iq_ref and the d-axis current instruction value id_ref based on the PI control. In the present exemplary embodiment, the d-axis current instruction value id_ref, which influences the strength of the magnetic flux passing through each coil, is set to 0. However, it is not limited to this.

Driving currents flowing through the coils for the A-phase and the B-phase of the first motor 402 are detected by current detectors 507 and 508 and then converted from analog values to digital values by an A/D converter 510. In the present exemplary embodiment, the period at which the A/D converter 510 outputs digital values is, for example, a period (e.g., 25 μs) shorter than the period T, at which the speed controller 502 acquires the deviation. However, it is not limited to this.

The current values of the driving currents converted from the analog values to the digital values by the A/D converter 510 are represented as current values iα and iβ in the stationary coordinate system by the following formulas, using a phase θe of the current vector illustrated in FIG. 17. The phase θe of the current vector is defined as the angle between the α-axis and the current vector. I represents the magnitude of the current vector.

$$i\alpha = I^* \cos \theta e \quad (1)$$

$$i\beta = I^* \sin \theta e \quad (2)$$

The current values iα and iβ are input to the coordinate converter 511 and an inductive voltage determiner 512.

The coordinate converter 511 converts the current values iα and iβ in the stationary coordinate system into a current value iq of the q-axis current and a current value id of the d-axis current in the rotating coordinate system by the following formulas.

$$id=\cos\theta*i\alpha+\sin\theta*i\beta \quad (3)$$

$$iq=-\sin\theta*i\alpha+\cos\theta*i\beta \quad (4)$$

To a subtractor 102, the q-axis current instruction value iq_ref output from the speed controller 502 and the current value iq output from the coordinate converter 511 are input. The subtractor 102 calculates the deviation between the q-axis current instruction value iq_ref and the current value iq, and outputs the calculated deviation to the current controller 503.

To a subtractor 103, the d-axis current instruction value id_ref output from the speed controller 502 and the current value id output from the coordinate converter 511 are input. The subtractor 103 calculates the deviation between the d-axis current instruction value id_ref, and the current value id and outputs the calculated deviation to the current controller 503.

Based on the PID control, the current controller 503 generates driving voltages Vq and Vd so that each of the deviations input to the current controller 503 becomes small. More specifically, the current controller 503 generates the driving voltages Vq and Vd so that each of the deviations becomes 0. Then, the current controller 503 outputs the driving voltages Vq and Vd to the inverse coordinate converter 505. The current controller 503 according to the present exemplary embodiment generates the driving voltages Vq and Vd based on the PID control. However, it is not limited to this. For example, the current controller 503 may generate the driving voltages Vq and Vd based on the PI control.

The inverse coordinate converter 505 inversely converses the driving voltages Vq and Vd in the rotating coordinate system, which are output from the current controller 503, into driving voltages Vα and Vβ in the stationary coordinate system by the following formulas.

$$V\alpha=\cos\theta*Vd-\sin\theta,*Vq \quad (5)$$

$$V\beta=\sin\theta,*Vd+\cos\theta*Vq \quad (6)$$

The inverse coordinate converter 505 outputs the inversely converted driving voltages Vα and Vβ to the inductive voltage determiner 512 and the PWM inverter 506.

The PWM inverter 506 includes a full-bridge circuit. The full-bridge circuit is driven by PWM signals based on the driving voltages Vα and Vβ input from the inverse coordinate converter 505. As a result, the driving currents iα and iβ corresponding to the driving voltages Vα and Vβ are supplied to the coils. In the present exemplary embodiment, the PWM inverter 506 includes a full-bridge circuit. However, the PWM inverter 506 may include a half-bridge circuit.

Next, a description is given of a method for determining the rotational phase θ. The rotational phase θ of the rotor is determined using the values of inductive voltages Eα and Eβ induced in the coils for the A-phase and the B-phase of the first motor 402 by the rotation of the first motor 402. The value of each inductive voltage is determined (calculated) by the inductive voltage determiner 512. More specifically, the inductive voltages Eα and Eβ are determined by the following formulas, based on the current values iα and iβ input from the A/D converter 510 to the inductive voltage determiner 512 and the driving voltages Vα and Vβ input from the inverse coordinate converter 505 to the inductive voltage determiner 512.

$$E\alpha=V\alpha-R*i\alpha-L*di\alpha/dt \quad (7)$$

$$E\beta=V\beta-R*i\beta-L*di\beta/dt \quad (8)$$

In these formulas, R represents coil resistance, and L represents coil inductance. The values of the coil resistance R and the coil inductance L are values specific to the first motor 402 in use and are stored in advance in the ROM 151*b* or a memory (not illustrated) provided in the motor control device 157.

The inductive voltages Eα and Eβ determined by the inductive voltage determiner 512 are output to a phase determiner 513.

Based on the ratio between the inductive voltages Eα and Eβ output from the inductive voltage determiner 512, the phase determiner 513 determines the rotational phase θ of the rotor of the first motor 402 by the following formula.

$$\theta=\tan^{-1}(-E\beta/E\alpha) \quad (9)$$

In the present exemplary embodiment, the phase determiner 513 determines the rotational phase θ by performing the calculation based on formula (9). However, it is not limited to this. For example, the phase determiner 513 may determine the rotational phase θ by referring to a table stored in the ROM 151*b* and illustrating the relationships between the inductive voltages Eα and Eβ, and the rotational phase θ corresponding to the inductive voltages Eα and Eβ.

The rotational phase θ of the rotor obtained as described above is input to a speed determiner 514, the inverse coordinate converter 505, and the coordinate converter 511.

Based on a change over time in the rotational phase θ output from the phase determiner 513, the speed determiner 514 determines the rotational speed w. The speed is determined using the following formula (10).

$$\omega=d\theta/dt \quad (10)$$

The speed determiner 514 outputs the determined rotational speed w to the subtractor 101.

The motor control device 157 repeatedly performs the above-described control.

As described above, the motor control device 157 according to the present exemplary embodiment performs the vector control for controlling current values in the rotating coordinate system using the phase feedback control so that the deviation between the instruction speed ω1_ref and the rotational speed w becomes small. By performing the vector control, it is possible to prevent a motor from entering a step-out state and prevent an increase in the motor sound and an increase in power consumption due to an excess torque.

Figure 19:
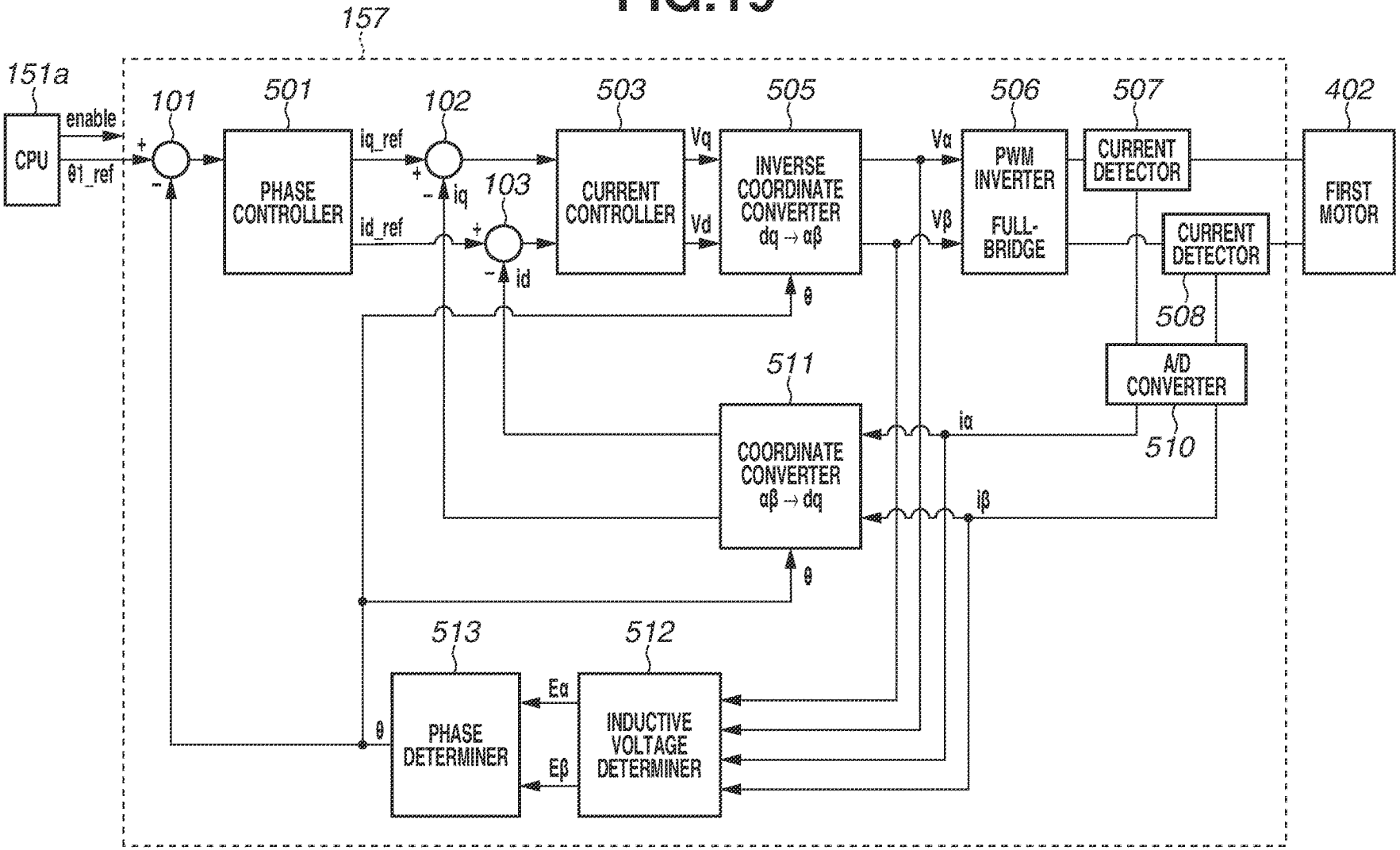
FIG. 19 is a block diagram illustrating an example of a configuration of a motor control device that performs phase feedback control.

In the vector control according to the present exemplary embodiment, the motor is controlled by performing the speed feedback control. However, it is not limited to this. For example, as illustrated in FIG. 19, the motor may be controlled by feeding back the rotational phase θ of the rotor.

In the present exemplary embodiment, a stepping motor is used as the motor for driving a load. Alternatively, another motor such as a DC motor or a brushless DC motor may be used. The motor is not limited to a two-phase motor. The present exemplary embodiment can also be applied to another motor such as a three-phase motor.

In the present exemplary embodiment, a permanent magnet is used as the rotor. However, it is not limited to this.

In the first to fifth exemplary embodiments, a description has been given of a configuration in which a load is driven using two motors. However, it is not limited to this. For example, the first to fifth exemplary embodiments may be applied to a configuration in which a load is driven using three or more motors.

According to the present exemplary embodiments, it is possible to drive a load with a less expensive configuration.

Embodiment(s) of the present disclosure can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may include one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random access memory (RAM), a read-only memory (ROM), a storage of distributed computing systems, an optical disk (such as a compact disc (CD), digital versatile disc (DVD), or Blu-ray Disc (BD)™), a flash memory device, a memory card, and the like.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2019-200314, filed Nov. 1, 2019, which is hereby incorporated by reference herein in its entirety.

What is claimed is:

1. An image forming apparatus comprising:

a transfer unit configured to transfer a toner image onto a recording medium;

a fixing unit including a first rotating member and a second rotating member forming a nip portion with the first rotating member configured to nip the recording medium, wherein the fixing unit is configured to fix the toner image transferred onto the recording medium by the transfer unit to the recording medium at the nip portion;

a first motor;

a second motor;

a drive transmission unit configured to transmit a driving force of the second motor; and an adjustment member having a position and configured to adjust a shaft-to-shaft distance between a first distance and a second distance that is shorter than the first distance, wherein the shaft-to-shaft distance is a distance between a first rotation shaft of the first rotating member and a second rotation shaft of the second rotating member, wherein the adjustment member is configured to move by the driving force of the second motor between a first position that is the position of the adjustment member in a state where the shaft-to-shaft distance is the first distance and a second position that is the position of the adjustment member in a state where the shaft-to-shaft distance is the second distance, and wherein the nip portion is formed by the first and second rotating members in the state where the shaft-to-shaft distance is the second distance, wherein the drive transmission unit operates in a first state where the driving force of the second motor is transmitted to the first rotating member and is not transmitted to the adjustment member, and in a second state where the driving force of the second motor is not transmitted to the first rotating member and is transmitted to the adjustment member, wherein, in a state where the driving force of the second motor is not transmitted to the adjustment member located at the second position, the adjustment member maintains the shaft-to-shaft distance at the second distance, and wherein, in a state where the drive transmission unit operates in the first state and the shaft-to-shaft distance is maintained at the second distance by the adjustment member located at the second position, the first rotating member is driven by both the first and second motors.

2. The image forming apparatus according to claim 1, wherein the drive transmission unit includes a first one-way clutch and a second one-way clutch, wherein, in a case where the second motor rotates in a first rotational direction that is a rotational direction of the second motor when the first rotating member conveys the recording medium, the first one-way clutch transmits the driving force of the second motor to the first rotating member, wherein, in a case where the second motor rotates in a second rotational direction that is a direction opposite to the first rotational direction, the first one-way clutch does not transmit the driving force of the second motor to the first rotating member, wherein, in a case where the second motor rotates in the second rotational direction, the second one-way clutch transmits the driving force of the second motor to the adjustment member, and wherein, in a case where the second motor rotates in the first rotational direction, the second one-way clutch does not transmit the driving force of the second motor to the adjustment member.

3. The image forming apparatus according to claim 1, further comprising:

a first control unit; and a second control unit, wherein the drive transmission unit includes a first transmission unit configured to transmit the driving force of the second motor to the first rotating member, and a second transmission unit configured to transmit the driving force of the second motor to the adjustment member, and wherein the first control unit is configured to switch the first transmission unit between the first state where the driving force of the second motor is transmitted to the first rotating member and the second state where the driving force of the second motor is not transmitted to the first rotating member, and the second control unit is configured to switch the second transmission unit between a state where the driving force of the second motor is transmitted to the adjustment member and the state where the driving force of the second motor is not transmitted to the adjustment member.

4. The image forming apparatus according to claim 1, wherein the adjustment member is a cam.

5. The image forming apparatus according to claim 1, wherein the second rotating member rotates by being driven by the first rotating member.

6. The image forming apparatus according to claim 1, wherein the second motor is a stepping motor.

7. The image forming apparatus according to claim 1, wherein the first motor is a stepping motor.

8. An image forming apparatus comprising:

a first rotating member;

a first motor configured to drive the first rotating member;

a rotating member pair including a second rotating member and a third rotating member and configured to convey a recording medium using the second and third rotating members;

a second motor;

a drive transmission unit configured to transmit a driving force of the second motor; and an adjustment member having a position and configured to adjust a shaft-to-shaft distance between a first distance and a second distance that is shorter than the first distance, wherein the shaft-to-shaft distance is a distance between a first rotation shaft of the second rotating member and a second rotation shaft of the third rotating member, wherein the adjustment member is configured to move by the driving force of the second motor between a first position that is the position of the adjustment member in a state where the shaft-to-shaft distance is the first distance and a second position that is the position of the adjustment member in a state where the shaft-to-shaft distance is the second distance, and wherein a nip portion is formed by the first and second rotating members in the state where the shaft-to-shaft distance is the second distance and is configured to nip the recording medium, wherein the drive transmission unit operates in a first state where the driving force of the second motor is transmitted to the first rotating member and is not transmitted to the adjustment member, and in a second state where the driving force of the second motor is not transmitted to the first rotating member and is transmitted to the adjustment member, wherein, in a state where the driving force of the second motor is not transmitted to the adjustment member located at the second position, the adjustment member maintains the shaft-to-shaft distance at the second distance, and wherein, in a state where the drive transmission unit operates in the first state and the shaft-to-shaft distance is maintained at the second distance by the adjustment member located at the second position, the first rotating member is driven by both the first and second motors.

9. The image forming apparatus according to claim 8, further comprising:

a photosensitive member;

a developing unit configured to develop a latent image formed on the photosensitive member;

a transfer belt onto which a toner image developed by the developing unit is transferred;

a transfer unit including the second and third rotating members, and configured to transfer the toner image formed on the transfer belt onto the recording medium by the second and third rotating members;

a reverse roller configured to reverse a first surface of the recording medium on which an image is formed, and a second surface of the recording medium, which is an opposite side of the first surface; and a guide unit configured to guide the recording medium to the transfer unit, wherein the first and second surfaces of the recording medium are reversed by the reverse roller, and wherein the first rotating member conveys the recording medium guided by the guide unit.

10. The image forming apparatus according to claim 9, further comprising a fourth rotating member provided downstream of the first rotating member in a conveying direction in which the first rotating member conveys the recording medium, wherein a conveyance guide between the first and fourth rotating members is curved.

11. The image forming apparatus according to claim 8, further comprising:

a fixing unit configured to fix a toner image formed on the recording medium to the recording medium; and a curl correction unit configured to correct by the rotating member pair a curl that occurs in the recording medium to which the image is fixed by the fixing unit.

12. The image forming apparatus according to claim 11, wherein the first rotating member comes into contact with the second rotating member, and wherein the second rotating member rotates by being driven by rotation of the first rotating member.

13. The image forming apparatus according to claim 8, wherein the adjustment member is a cam.

14. The image forming apparatus according to claim 8, wherein the second motor is a stepping motor.

15. The image forming apparatus according to claim 8, wherein the first motor is a stepping motor.

* * * * *